US010005976B2

(12) United States Patent
Murray, Sr. et al.

(10) Patent No.: US 10,005,976 B2
(45) Date of Patent: Jun. 26, 2018

(54) HEAT EXCHANGER ON A FOSSIL FUEL PROCESSING ASSEMBLY

(71) Applicant: PRIDE OF THE HILLS MANUFACTURING, INC., Big Prairie, OH (US)

(72) Inventors: Curtis W. Murray, Sr., Big Prairie, OH (US); Curtis W. Murray, Jr., Wooster, OH (US); Leroy P. Whited, Elyria, OH (US); Dustin Baker, Shreve, OH (US)

(73) Assignee: PRIDE OF THE HILLS MANUFACTURING, INC., Big Prairie, OH (US)

( * ) Notice: Subject to any disclaimer, the term of this patent is extended or adjusted under 35 U.S.C. 154(b) by 238 days.

(21) Appl. No.: 15/144,852

(22) Filed: May 3, 2016

(65) Prior Publication Data

US 2016/0245592 A1 Aug. 25, 2016

Related U.S. Application Data

(63) Continuation-in-part of application No. 15/140,908, filed on Apr. 28, 2016, which is a continuation-in-part (Continued)

(51) Int. Cl.

| | |
|---|---|
| ***F28D 15/02*** | (2006.01) |
| ***F28D 1/047*** | (2006.01) |
| ***F28D 1/02*** | (2006.01) |
| ***C10L 3/10*** | (2006.01) |
| ***F28D 1/04*** | (2006.01) |
| *F28D 21/00* | (2006.01) |

(52) U.S. Cl.

CPC ..... *C10L 3/101* (2013.01); *F28D 1/0213* (2013.01); *F28D 1/0408* (2013.01); *F28D 1/0477* (2013.01); *C10L 2290/06* (2013.01); *F28D 2021/0059* (2013.01)

(58) Field of Classification Search

CPC combination set(s) only.
See application file for complete search history.

(56) References Cited

U.S. PATENT DOCUMENTS

| | | | |
|---|---|---|---|
| 1,661,000 | A | 2/1928 | Madden et al. |
| 2,761,397 | A | 9/1956 | Hoist |

(Continued)

FOREIGN PATENT DOCUMENTS

JP S6154156 B2 * 11/1986

*Primary Examiner* — Kaity Chandler
(74) *Attorney, Agent, or Firm* — Sand & Sebolt

(57) ABSTRACT

The fossil fuel processing apparatus of the present disclosure includes two pressure vessels, or two separators, above a single vessel footprint area in a vertically stacked configuration. The stacked configuration permits the processing of gas to occur in a space having less length and less width than that of two separators arranged tip-to-end or side-by-side, respectively. The first and second separators are configured to separate fuel from non-fuel in a footprint area of a single gas separator as the fuel moves from upstream to downstream through a gas processing system. Further, the gas processing apparatus of the present disclosure permits the two separators to fit in a housing compartment that is more easily transportable via tractor-trailer.

13 Claims, 26 Drawing Sheets

Related U.S. Application Data of application No. 14/873,657, filed on Oct. 2, 2015, now abandoned.

(60) Provisional application No. 62/060,899, filed on Oct. 7, 2014.

(56) References Cited

U.S. PATENT DOCUMENTS 2,781,425 A 2/1957 Glowzinski et al.
3,479,043 A 11/1969 Piehl
3,605,421 A * 9/1971 Patrick ..... B60H 1/3202 62/394
3,714,793 A 2/1973 Eigenbrod
3,799,383 A 3/1974 Gerhard
4,060,174 A 11/1977 Gerhard
4,122,761 A 10/1978 Westin et al.
4,344,568 A * 8/1982 Stewart ..... F24D 1/02 122/20 B
5,061,177 A * 10/1991 Knipiler ..... F24H 3/08 34/86
5,526,583 A 6/1996 Hull et al.
5,685,350 A 11/1997 Chowdhury
5,727,481 A 3/1998 Voorhees et al.
6,314,919 B1 * 11/2001 Pugachev ..... F02M 23/02 123/3
6,786,245 B1 9/2004 Eichelberger et al.
7,220,365 B2 * 5/2007 Qu ..... C09K 5/14 165/104.15
9,117,558 B1 * 8/2015 Pennington ..... G21F 5/10
9,780,392 B2 * 10/2017 Perry ..... H01M 8/04022
2003/0019214 A1 * 1/2003 Shibata ..... F01K 21/047 60/775
2003/0030279 A1 2/2003 Campion
2003/0101651 A1 * 6/2003 Weedon ..... B01J 8/062 48/197 R
2003/0159913 A1 8/2003 Murcia
2005/0126171 A1 * 6/2005 Lasker ..... F02C 1/04 60/645
2006/0213370 A1 9/2006 Leonard et al.
2007/0095205 A1 5/2007 Palumbo
2008/0164251 A1 7/2008 Fawley
2008/0209918 A1 9/2008 White
2008/0252078 A1 10/2008 Myers et al.
2008/0282883 A1 11/2008 Rarig et al.
2010/0191615 A1 7/2010 Thomas
2010/0212874 A1 8/2010 Min et al.
2012/0061481 A1 * 3/2012 Wei ..... F24D 11/004 237/56
2012/0318608 A1 12/2012 Dupont
2013/0125838 A1 * 5/2013 Min ..... F24H 8/00 122/20 B
2013/0239845 A1 9/2013 Frazier et al.
2013/0247842 A1 * 9/2013 Chandler ..... F24H 1/06 122/14.2
2014/0250932 A1 9/2014 Martinez, Jr. et al.
2014/0305926 A1 10/2014 Tummillo et al.
2015/0343408 A1 12/2015 Frye et al.

* cited by examiner

| FIG.17A | FIG.17B | FIG.17C |
|---|---|---|

| FIG.18A | FIG.18B | FIG.18C |
|---|---|---|

HEAT EXCHANGER ON A FOSSIL FUEL PROCESSING ASSEMBLY

CROSS REFERENCE TO RELATED APPLICATION

This disclosure is a continuation-in-part from, and claims the benefit of, prior U.S. patent application Ser. No. 15/140,908 filed on Apr. 28, 2016, which is continuation-in-part from prior U.S. patent application Ser. No. 14/873,657 filed on Oct. 2, 2015, which claims the benefit of and priority to prior U.S. Provisional Application Ser. No. 62/060,899, filed Oct. 7, 2014: the disclosures of each are entirely incorporated herein by reference as if fully rewritten.

BACKGROUND

Technical Field

The present disclosure relates generally to the field of fossil fuel processing devices. More particularly, the present disclosure relates to separators for separating fuel from non-fuels. Specifically, the present disclosure relates to a gas processing apparatus including two sets of vertically stacked gas separators configured to separate fuel from non-fuel inside two respective housings.

Background Information

Fossil fuel exploration and drilling is a booming industry that often requires extracting operations to occur in remote areas. The remoteness of some well sites increases the difficulty for transporting drilling components and processing units as the roadway infrastructure may not be fully developed to handle such an aggressive construction timeline for extracting the fossil fuels. Some gas processing systems require two separators to cooperate together in separating fuel from non-fuel, particulates, and other liquids as natural gas or fossil fuels are extracted from the ground.

After extracting fossil fuel from an in-ground well, the fossil fuel must be processed in a gas processing system before it can be sold to and consumed by the public. Many types of gas processing systems are known to exist, and there are a variety of components in gas processing systems.

One common component in a gas processing system is a separator. A separator is a pressure vessel configured to separate fuel from the non-fuel matter, such as particulates and water that are extracted with the fossil fuel from the well head during the gas extraction process. Some gas processing systems include two or more separators, such as a first high pressure separator and a second lower pressure separator. They cooperate to route separated and processed gas to a sales pipeline for consumption.

To date, two separator systems are aligned in a side-by-side basis that require a housing to be quite wide. These wide housings are very often wider than the federal highway maximum width for transporting goods on a highway. As such, suppliers of these vessels must obtain a special wide load permit to ship these two side-by-side separators.

SUMMARY

Issues continue to exist with gas processing systems that include two or more gas separators. These separators are large devices and often take up a significant amount of space which increases costs of materials for housing components, shipping/transport costs associated with moving large items, amongst other things, for both consumers and suppliers in the gas processing industry. The present disclosure addresses these and other issues.

In one aspect, the disclosure may provide a gas processing apparatus comprising: a first gas processing vessel; and a second gas processing vessel positioned above the first vessel, the first and second vessels configured to separate fuel from non-fuel in a footprint area as the fuel moves from upstream to downstream through a gas processing system.

In another aspect, the disclosure may provide at least two gas processing pressure vessels positioned above a single pressure vessel footprint area, the at least two vessels configured to process fuel moving from upstream to downstream through a gas processing system.

In yet another aspect, an embodiment of the disclosure may provide a method of use for a stacked gas processing vessel comprising the steps of: moving fuel into a first gas processing vessel through an inlet; moving fuel out of the first gas processing vessel through an outlet; moving fuel vertically towards a second gas processing vessel; moving fuel into the second gas processing vessel through an inlet; and moving fuel out of the second gas processing vessel through an outlet.

In another aspect, an embodiment of the disclosure may provide a method of use for stacked gas processing separators comprising the steps of: providing at least two gas separators configured to process fuel moving through a gas processing system by separating fuel matter from non-fuel matter; and positioning the two separators above a footprint area to form a vertically stacked configuration, the footprint area generally defined as the length of about one separator multiplied by the width of about one separator, the footprint area on a floor with a floor width less than a width of two separators in a side-by-side configuration.

In another aspect, the disclosure may provide a gas processing apparatus that includes two pressure vessels, or two separators, above a single vessel footprint area in a vertically stacked configuration. The stacked configuration permits the processing of gas to occur in a space having less length or less width than that of two separators arranged tip-to-end or side-by-side, respectively. The first and second separators are configured to separate fuel from non-fuel in a footprint area of a single gas separator as the fuel moves from upstream to downstream through a gas processing system. Further, the gas processing apparatus of the present disclosure permits the two separators to fit in a housing compartment that is more easily transportable via tractor-trailer.

Further, issues continue to exist with dual separators arranged in a side-by-side configuration. The present disclosure addresses these and other issues by providing a gas processing housing box able to retain two gas processing pressure vessels therein while maintaining a width narrower than the United States Department of Transportation Federal Highway Administration maximum width for a commercial vehicle.

In one aspect, an embodiment of the disclosure may provide a transportable housing for a gas processing apparatus comprising: a chamber defined by a plurality of housing walls joined together to therein retain at least two gas processing pressure vessels in a vertically stacked configuration; and a housing width narrower than the United States Department of Transportation Federal Highway Administration maximum width for a commercial vehicle to allow transportation of the housing without the need for an oversized/wide load shipping permit.

In one aspect, an embodiment of the disclosure may provide a housing for two vertically stacked fuel separators comprising: a first sidewall on a housing box therein defining a chamber; a second sidewall on the housing box spaced apart from the first sidewall; a housing width distance, defined from the first sidewall to the second sidewall, less than about 102 inches; the chamber adapted to therein contain two vertically stacked gas processing separators and a gas processing heater; and a heat exchanging container within the chamber.

In another aspect, the disclosure may provide a gas processing apparatus housing comprising: a floor having a width; a housing chamber defined by the floor and connected walls, the chamber adapted to retain a pair of gas processing pressure vessels in a vertically stacked configuration; and the floor width less than a width for the pair of pressure vessels if the vessels were in a side-by-side configuration.

In yet another aspect, an embodiment may provide a method of constructing a housing for a stacked gas processing apparatus, comprising the steps of: forming a housing first section to retain a stacked gas processing apparatus therein; connecting the housing first section to a housing second section to form a box-like structure and having a housing width narrower than the United States Department of Transportation Federal Highway Administration maximum width for a commercial vehicle to permit transportation of the housing without the need for an oversized/wide load shipping permit.

In another aspect, an embodiment may provide a method of use for two gas processing pressure vessels comprising the steps of: mounting two gas processing pressure vessels in a stacked configuration within a chamber of a gas processing housing; and attaching a wall to the housing to enclose the chamber, wherein the housing includes a housing width narrower than the United States Department of Transportation Federal Highway Administration maximum width for a commercial vehicle to allow transportation of the housing without the need for an oversized load shipping permit. Then, further comprising the step of transporting the housing on a road without an oversized load shipping permit.

In another aspect, the disclosure may provide a housing for a gas processing apparatus formed by a plurality of walls joined together to form a box-like structure defining a chamber therein. The chamber is configured to retain a pair or more of gas processing pressure vessels in a vertically stacked configuration. The housing has a width less the United States Department of Transportation Federal Highway Administration maximum width for a commercial vehicle to allow transportation of the housing without the need for an oversized load shipping permit. The floor width inside the chamber less than a width for said pair of pressure vessels if said vessels were in a side-by-side configuration.

Further, issues may continue to exist with gas processing housings that can only hold two or three units therein. For example, at some well site locations, there may be up to six or more wells pumping fossil fuel from the ground. Thus, there exists a need for an improved transportable gas processing system that is formed from a first gas processing modular unit and a second gas processing modular unit; wherein each unit houses or supports a plurality of gas processing vessels at least equal to the number of wells at the site location.

In another aspect, the disclosure may provide a gas processing system comprising: a first module unit supported by a first frame having a first width and a first length dimensionally sized for transport by a tractor trailer without a wide load permit; a first set of gas processing devices supported by the first module unit; a second module unit supported by a second frame having a second width and a second length dimensionally sized for transport by a second tractor trailer without a wide load permit; a second set of gas processing device supported by second module unit; and a junction directly connecting the first module to the second module.

Another aspect may provide, a method of processing fossil fuel comprising the steps of: pumping fossil fuel from a first well head at a well site location along a first gas flow pathway; pumping fossil fuel from a second well head at the well site location along a second gas flow pathway; decreasing pressure of the fossil fuel along the first gas flow pathway in a first set of heat exchanging pipeline submerged in heated fluid; decreasing pressure of the fossil fuel along the second gas flow pathway in a second set of heat exchanging pipeline submerged in heated fluid; separating fossil fuel from other constituents along the first gas flow pathway in a first gas separator; separating fossil fuel from other constituents along the second gas flow pathway in a second gas separator; wherein the first and second gas separators are housed in a first module and aligned in a vertically stacked configuration; combining the first and second gas flow pathways downstream from the first and second gas separators.

In yet another aspect, an embodiment of the present disclosure may provide a method for installing a gas processing system comprising the steps of: hauling a first gas processing module by a tractor trailer to adjacent a fossil fuel well site location without an oversized load permit; unloading the first gas processing module from the tractor trailer; hauling a second gas processing module by a tractor trailer to the well site location without an oversized load permit; unloading the second gas processing module from the tractor trailer; and joining the first gas processing module with the second gas processing module at a junction.

In yet another aspect, an embodiment of the present disclosure may provide a heat exchanger on a fossil fuel processing assembly comprising: a container defining a plurality of distinct fluid filled chambers; a plurality of heat sources equal to the number of fluid filled chambers, wherein one heat source is disposed within one chamber; and a plurality of heat exchanging pipelines equal to the number of fluid filled chambers, wherein one pipeline is submerged within in fluid inside one chamber and the pipelines bounding fossil fuel flowing therethrough.

In yet another aspect, an embodiment of the present disclosure may provide a heat exchanger on a fossil fuel processing assembly comprising: a first endwall opposite a second endwall defining a longitudinal direction therebetween, a first sidewall opposite a second sidewall defining a transverse direction therebetween, and a top wall opposite a bottom wall defining a vertical direction therebetween; the first endwall, second endwall, first sidewall, second sidewall, top wall, and bottom wall are joined together forming a box-like configuration defining a chamber therein; a fluid at least partially filling and bound in the chamber; a heat source at least partially submerged in the fluid; a first heat exchanging pipeline submerged in the fluid arranged in a general serpentine configuration, the first heat exchanging pipeline defining a portion of a first fossil fuel flow pathway from a first fuel source, wherein the first heat exchanging pipeline includes: a plurality of pre-heat pipe segments adjacent the heat source adapted to warm fossil fuel fluidly moving through the pre-heat pipe segments; and a plurality of expansion pipe segments in downstream fluid communication with the plurality of pre-heat pipe segments adapted to permit fossil fuel expansion therein as the fossil fuel fluidly moves through the expansion pipe segments.

In yet another aspect, an embodiment of the present disclosure may provide a heat exchanger on a fossil fuel processing assembly comprising: a first endwall opposite a second endwall defining a longitudinal direction therebetween, a first sidewall opposite a second sidewall defining a transverse direction therebetween, and a top wall opposite a bottom wall defining a vertical direction therebetween; a first partition wall extending transversely between the first and second sidewalls and extending longitudinally between the first and second endwalls; wherein the first and second endwalls, the first and second sidewalls, the top wall, and the first partition wall define a first chamber; a second partition wall below the first partition wall extending transversely between the first and second sidewalls and extending longitudinally between the first and second endwalls; wherein the first and second endwalls, the first and second sidewalls, the first partition wall, and the second partition wall define a second chamber below the first chamber; wherein the first and second endwalls, the first and second sidewalls, the second partition wall, and the bottom wall define a third chamber below the first and second chambers; a first fluid at least partially filling and bound in the first chamber; a second fluid at least partially filling and bound in the second chamber; a third fluid at least partially filling and bound in the third chamber; wherein the first, second, and third fluids are similar formulations but do not mix; a first heat source at least partially submerged in the first fluid in the first chamber; a second heat source at least partially submerged in the second fluid in the second chamber; a third heat source at least partially submerged in the third fluid in the third chamber; a first heat exchanging pipeline submerged in the first fluid in the first chamber having a plurality of parallel segments connected together by transitional segments forming a general serpentine configuration, the first heat exchanging pipeline defining a portion of a first fossil fuel flow pathway from a first fuel source, and including a plurality of pre-heat pipe segments serially connected adjacent the first heat source adapted to warm fossil fuel fluidly moving through the pre-heat pipe segments and a plurality of expansion pipe segments serial connected in downstream fluid communication with the plurality of pre-heat pipe segments adapted to permit fossil fuel expansion therein as the fossil fuel fluidly moves through the expansion pipe segments; a second heat exchanging pipeline submerged in the second fluid in the second chamber having a plurality of parallel segments connected together by transitional segments forming a general serpentine configuration, the second heat exchanging pipeline defining a portion of a second fossil fuel flow pathway from a second fuel source, and including a plurality of pre-heat pipe segments serially connected adjacent the second heat source adapted to warm fossil fuel fluidly moving through the pre-heat pipe segments and a plurality of expansion pipe segments serially connected in downstream fluid communication with the plurality of pre-heat pipe segments adapted to permit fossil fuel expansion therein as the fossil fuel fluidly moves through the expansion pipe segments; a third heat exchanging pipeline submerged in the third fluid in the third chamber having a plurality of parallel segments connected together by transitional segments forming a general serpentine configuration, the third heat exchanging pipeline defining a portion of a third fossil fuel flow pathway from a third fuel source, and including a plurality of pre-heat pipe segments serially connected adjacent the third heat source adapted to warm fossil fuel fluidly moving through the pre-heat pipe segments and a plurality of expansion pipe segments serially connected in downstream fluid communication with the plurality of pre-heat pipe segments adapted to permit fossil fuel expansion therein as the fossil fuel fluidly moves through the expansion pipe segments.

BRIEF DESCRIPTION OF THE SEVERAL VIEWS OF THE DRAWINGS

A sample embodiment of the disclosure, illustrative of the best mode in which Applicant contemplates applying the principles, is set forth in the following description, is shown in the drawings and is particularly and distinctly pointed out and set forth in the appended claims. The accompanying drawings, which are incorporated in and constitute a part of the specification, illustrate various example methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

Figure 1:
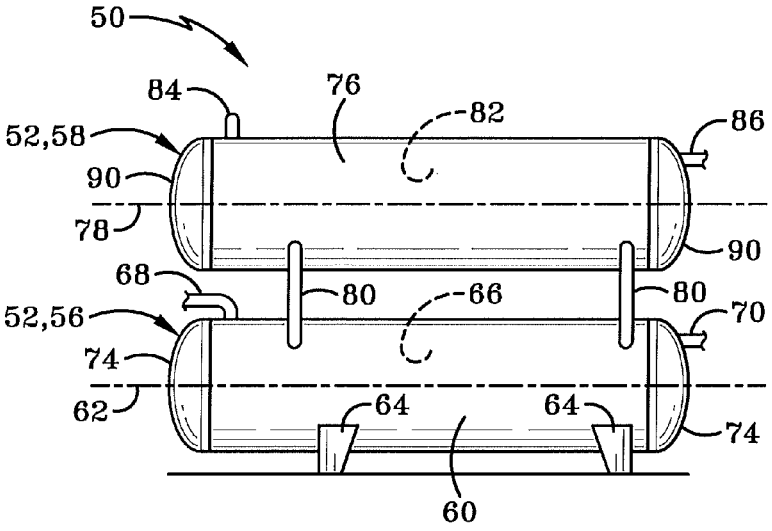
FIG. 1 is a side elevation view of a gas processing apparatus of the present disclosure depicting two pressure vessels, a first separator and a second separator, in a vertically stacked configuration.
Figure 2:
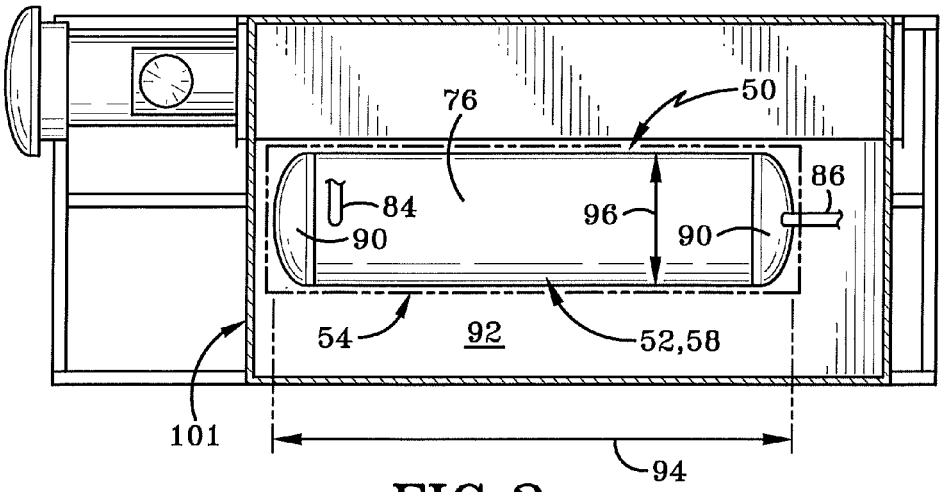
FIG. 2 is a top view of the gas processing apparatus shown installed in a housing.

As depicted in FIG. 1, a gas processing apparatus 50 of the present disclosure includes at least two gas processing pressure vessels 52 positioned above a single pressure vessel footprint area 54 (FIG. 2). The at least two pressure vessels 52 are configured to process fuel moving from upstream to downstream through a gas processing system. In one particular embodiment of the gas processing apparatus 50, the least two gas processing pressure vessels 52 include a longitudinally oriented first gas separator 56 and a longitudinally oriented second gas separator 58.

With continued reference to FIG. 1, first separator 56 includes a generally cylindrical vessel body 60 extending along a longitudinal axis 62 and supported by a frame 64. Vessel body 60 defines a chamber 66 for therein separating fuel from non-fuel (particulates and non-fuel liquids such as water) as fuel is moved from upstream to downstream through the separator inlet 68 and outlet 70, respectively, as one having ordinarily skill in the fossil fuel or gas processing field would understand. A separator radius 72 (FIG. 4) extends from longitudinal axis 62 to inner surface of vessel body 60. In the shown embodiment, cylindrical vessel body 60 of first separator includes an outer circumferential surface capped at each end with hemispherical ends 74.

The second separator 58 is configured similarly to the first separator 56 and includes a generally cylindrical vessel body 76 extending along a longitudinal axis 78 and supported by a frame 80. Vessel body 76 defines a chamber 82 for therein separating fuel from non-fuel as fuel is moved from upstream to downstream through the separator inlet 84 and outlet 86, respectively, as one having ordinarily skill in the gas processing field would understand. A second separator radius 88 (FIG. 4) extends from longitudinal axis 78 to inner surface of vessel body 76. In the shown embodiment, cylindrical vessel body 76 of second separator 58 includes an outer circumferential surface capped at each end with hemispherical end caps 90.

As depicted in FIG. 2, first and second separators 56, 58 are mounted to a platform or floor surface 92 above the footprint area 54. The footprint area 54 is on the floor surface 92 and generally defined as the space directly beneath the first separator 56 equal to the length 94 of the first separator multiplied by the width 96 of the first separator 56. Platform 92 is on a gas processing box-housing 101 for containing the gas processing apparatus 50 of the present disclosure therein. The housing 101 may also retain therein additional elements ordinarily associated with a gas processing system, by way of non-limiting example, valves, hoses, gauges, or pressure chokes.

Figure 3:
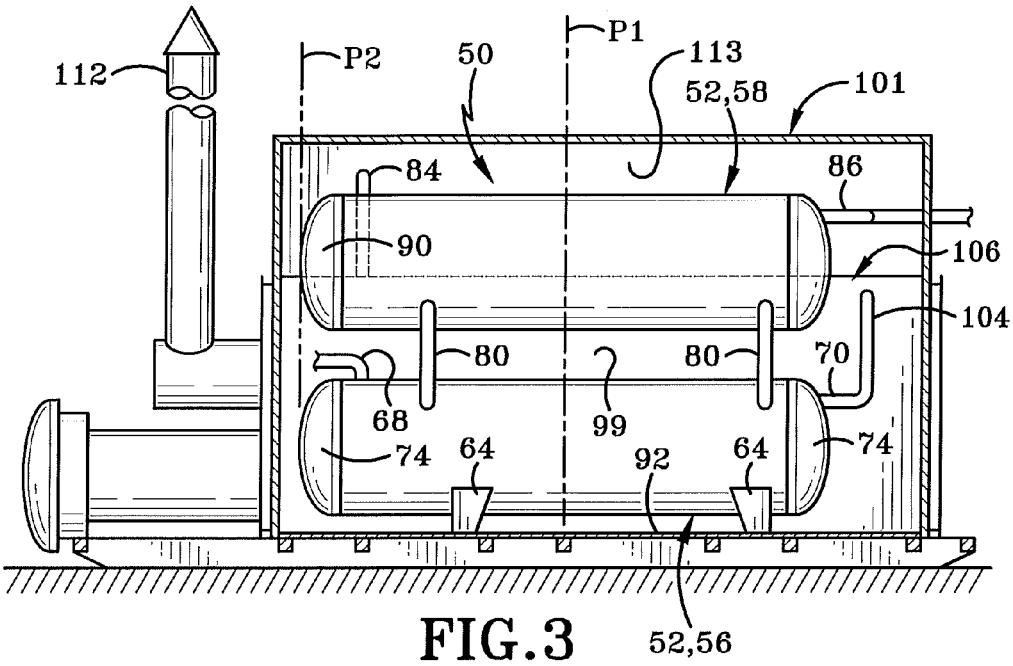
FIG. 3 is a side elevation view of the gas processing apparatus shown installed in the housing.

As depicted in FIG. 3, when the gas processing apparatus is mounted on the platform 92 above the footprint area 54, a section of the first separator 56 is radially coplanar with a section on the second separator 58 along a radial plane P1. Further in one particular embodiment, a surface on the first separator 56, such as the tip of the first separator hemispheric end cap 74, is in the same radial plane P2 or radially coplanar with a surface on the second separator 58, such as the tip of the second separator hemispheric end cap 90.

Figure 4:
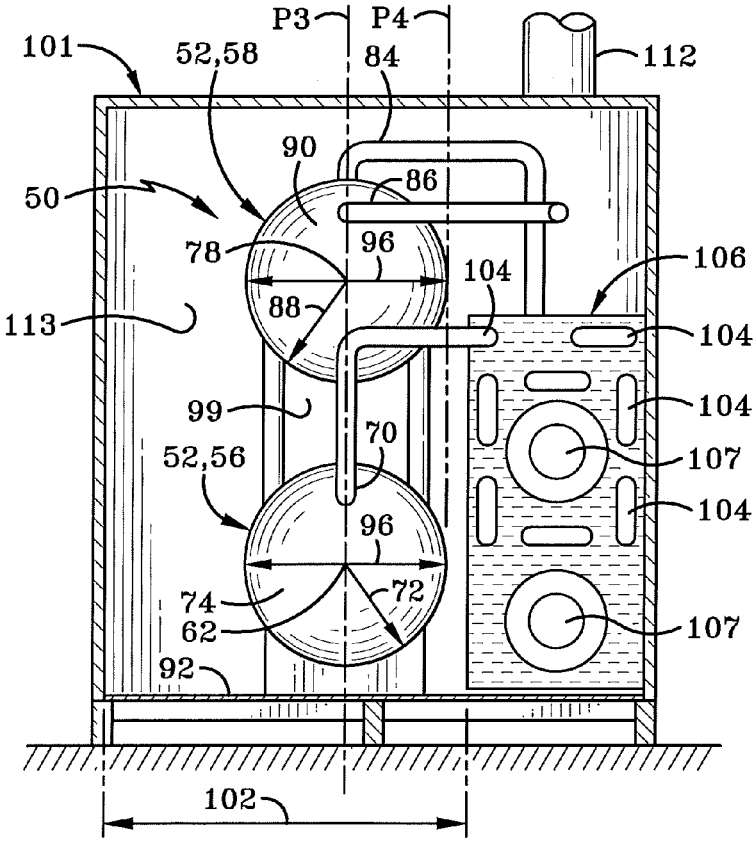
FIG. 4 is an end elevation view of the gas processing apparatus shown installed in the housing.

As depicted in FIG. 4, when the gas processing apparatus is mounted on the platform 92 above the footprint area 54 in the housing 101, the longitudinal axis 62 of the first separator 56 and the longitudinal axis 78 of the second separator 58 are axially coplanar along an axial plane P3. Further in one particular embodiment, an axially extending outer surface on the first separator 56, such as vessel body outer surface on the first separator 56, is in the same axial plane P4 or axially coplanar with an outer surface on the second separator 58, such as the vessel body outer surface on the second separator 58.

With continued reference to FIG. 4, an inter-vessel space 99 is defined between the two pressure vessels (first separator 56 and second separator 58). The bottom of the inter-vessel space 99 is bound by the top circumferential outer surface on the first separator 56. The top of the inter-vessel space 99 is bound by the bottom circumferential outer surface on the second separator 58.

These respective radial (FIG. 3) and longitudinal (FIG. 4) coplanar configurations ensure the second separator 58 alignment directly above first separator 56, and the stacked two separators are above the footprint area 54 of a single separator. In the shown embodiments, first and second separators have similar dimensions, yet there may be instances where the second or upper vessel may have a smaller diameter, which would permit the longitudinal axis of the second separator to be offset from a first separator axial plane while still being located above the first separator in the footprint area. The outer surfaces may remain coplanar along plane P4 even though there are different radiuses. Similarly, the outer surfaces may remain coplanar along plane P2 even though upper separator may have a different (i.e., shorter) length than the first separator 56.

Figure 5:
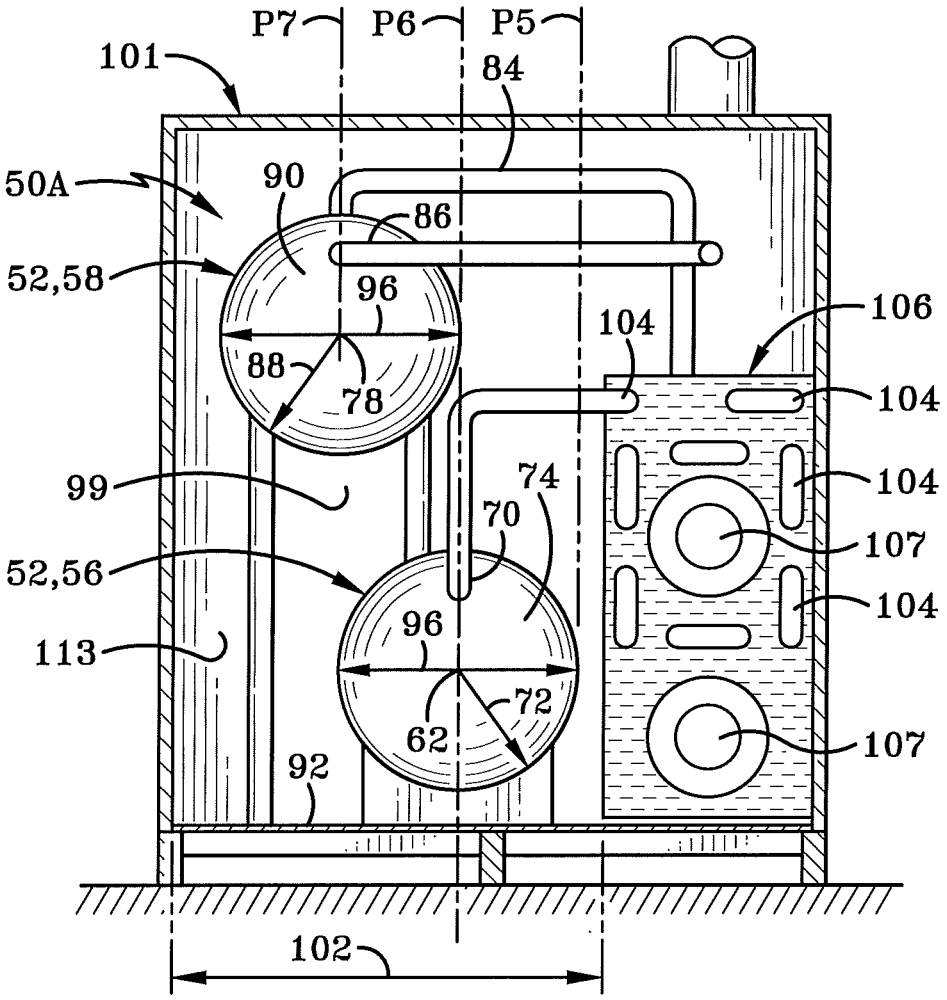
FIG. 5 is an end elevation view of an alternative embodiment of the present disclosure depicting a gas processing apparatus including offset stacked separators installed in the housing.

As depicted in FIG. 5, an alternate embodiment of the present disclosure includes stacked separators 50A wherein the top of first separator 56 is adjacent the bottom of second separator 58. In this way, the two separators 56, 58 are not directly vertical. Separators 56, 58 may be slightly offset from each other while second separator 58 still is generally above first separator 56. In this embodiment, the right outer circumferential of edge of the first separator 56 is in plane P5. The centerline axis 62 of first separator 56 is coplanar with the outer circumferential edge of second separator 58 in plane P6. The centerline axis 78 of second separator 58 is coplanar with a left outer circumferential edge of first separator 56 in plane P7.

In accordance with an aspect of the present disclosure, the gas processing apparatus including two pressure vessels 52, or two separators, above a single vessel footprint area permits the processing of gas to occur in a space having less length and less width than that of two separators arranged tip-to-end or side-by-side, respectively. The gas processing apparatus of the present disclosure permits the two separators 52 to fit inside a chamber 113 defined by housing 101 that is more easily transportable via tractor-trailer, since the gas processing apparatus 50 occupies less longitudinal distance and less width distance than two separators arranged tip-to-end or side-by-side, respectively. While the stacked configuration of two gas separators 52 disclosed herein may have a larger height than a tip-to-end or a side-by-side arrangement of two separators, tractor-trailer size limitations ordinarily are more limited by length and width, rather than height.

In operation and as detailed throughout FIGS. 2-5, a method for use of the stacked gas processing separator apparatus 50 of the present disclosure includes the steps of: providing at least two gas separators 52 configured to process fuel moving through a gas processing system by separating fuel matter from non-fuel matter; and positioning the two separators 52 above a single separator footprint area 54 to form a vertically stacked configuration, the footprint area 54 generally defined as the length 94 of about one separator multiplied by the width 96 of about one separator. Then, installing the stacked two separators in a box-housing 101, wherein the box-housing has a floor width 102 (FIG. 5) less than the combined width of the two separators if they were in a side-by-side configuration. Stated otherwise, the sum of width 96 of the two separators 56, 58 is greater than the floor width 102.

Figure 6:
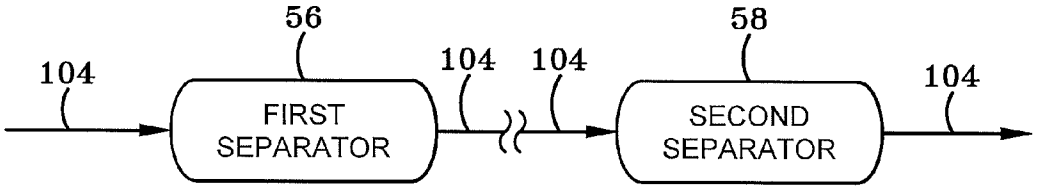
FIG. 6 is a first schematic view depicting the first and second separators of the gas processing apparatus connected via pipeline in a series configuration.

In operation and as detailed in the schematic of FIG. 6, first separator 56 and second separator 58 are connected via gas pipeline 104 in a series configuration wherein the first separator 56 is upstream from the second separator 58. Fossil fuels extracted from a well are processed moving downstream through a gas processing system in the pipeline 104 into the first separator 56 through inlet 68 (FIG. 3) wherein fuel is separated from non-fuels and exits through outlet 70 (FIG. 3). Fuel then moves in an angled direction between −90 and 90 degrees relative to horizontal. Preferably the fuel moves between 45 and 90 degrees upward from first separator 56 to second separator 58. Alternatively, the separators 56, 58 could be arranged such that the fuel moves downward between first and second separators. The fuel continues to flow via pipeline 104 into second separator 56 through inlet 84 (FIG. 3) wherein the fuel is separated again from any remaining non-fuel that remained after flowing through the first separator 56. Fuel exits second separator 58 through outlet 86 (FIG. 3) and flows downstream through the remaining portions of the gas processing system. While the schematic of FIG. 6 is shown in a linear relationship, this only represents the series configuration of the two separators and the actual physical arrangement of the two separators will be vertically above the single footprint area.

Figure 7:
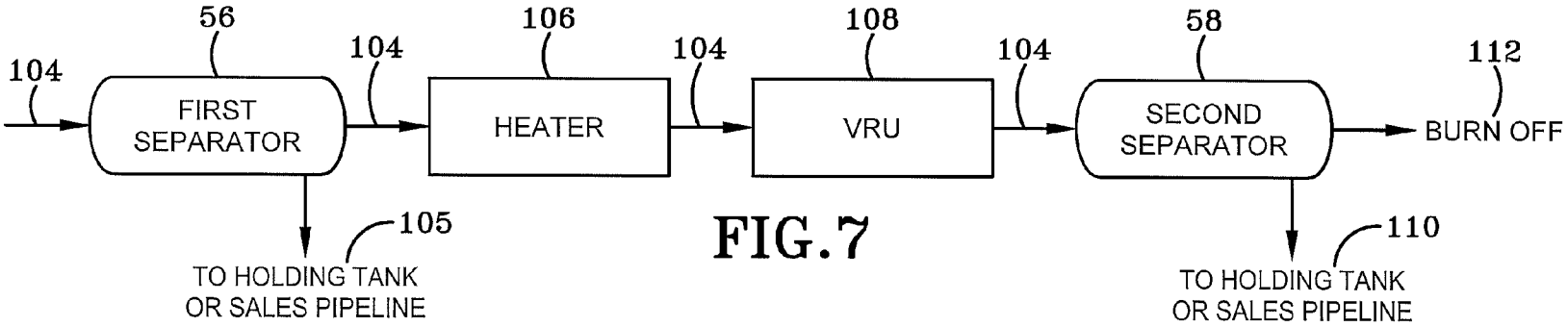
FIG. 7 is a second schematic view depicting the first and second separators of the gas processing apparatus connected via pipeline in a series configuration with a heating unit positioned downstream from the first separator and upstream from the second separator.

In operation and as detailed in the schematic of FIG. 7, fuel moves from a well through a gas processing system via pipeline 104 where the fuel is separated from a non-fuel in the first separator 56. In this particular embodiment, non-fuel refers to particulates and non-fuel liquids such as water. A first amount of separated fuel is then metered off in a metering device and sent to a downstream destination such as a holding tank or a sales pipeline 105. A second amount of the fuel is sent to a heating unit 106. The second amount of fuel is heated in the heating unit 106 via submerged heating element 107 to create a fuel vapor. The fuel vapor is then sent downstream via pipeline 104 to a vapor recovery unit 108. The fuel vapors are separated from any remaining non-fuel vapors in the second separator 58. From the second separator outlet the separated fuel vapors may flow to and be recovered in an additional vapor recovery unit. After recovering the fuel vapor, the second amount of fuel may be metered through outlet leading to a holding tank or sales line 110, or may be sent to a flume stack 112 to be burned off. Again, while the schematic of FIG. 7 is shown in a linear relationship, this only represents the series configuration of the two separators and the heating unit positioned between the two separators. In one particular embodiment, the actual physical arrangement of the two separators will be vertically above the single footprint area, and the heating unit will be adjacent the two stacked separators outside the footprint area.

Further, the broken lines along pipeline indicated in schematic views FIGS. 6-7 indicate that additional gas processing components may be located between the identified components of the present disclosure along the gas processing stream as one in the art would comprehend.

One preliminary exemplary housing 101 for a gas processing apparatus of the present disclosure is depicted throughout FIGS. 8A-15. Housing 101 is an improved device including a chamber 113 (FIG. 8B) defined by a plurality of housing walls 114 joined together to therein retain at least two gas processing pressure vessels 50 in a vertically stacked configuration. Housing 101 includes a housing width 118 (FIG. 13) narrower than the United States Department of Transportation Federal Highway Administration maximum width for a commercial vehicle to permit transportation (i.e., shipment) of the housing without the need for an oversized load shipping permit.

Figure 8A:
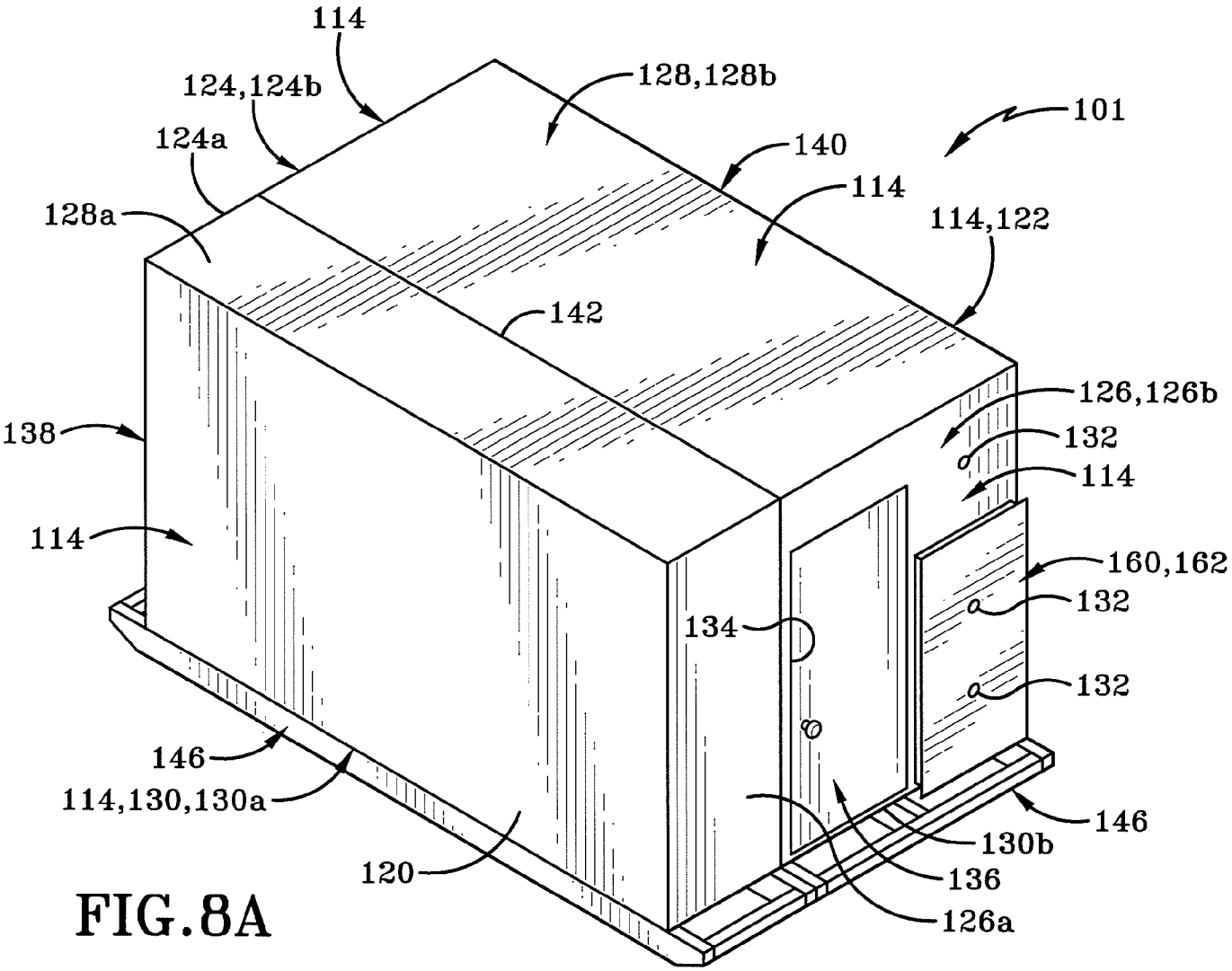
FIG. 8A is an assembled perspective view of an exemplary housing for a gas processing apparatus having a single column of stacked separators.
Figure 8B:
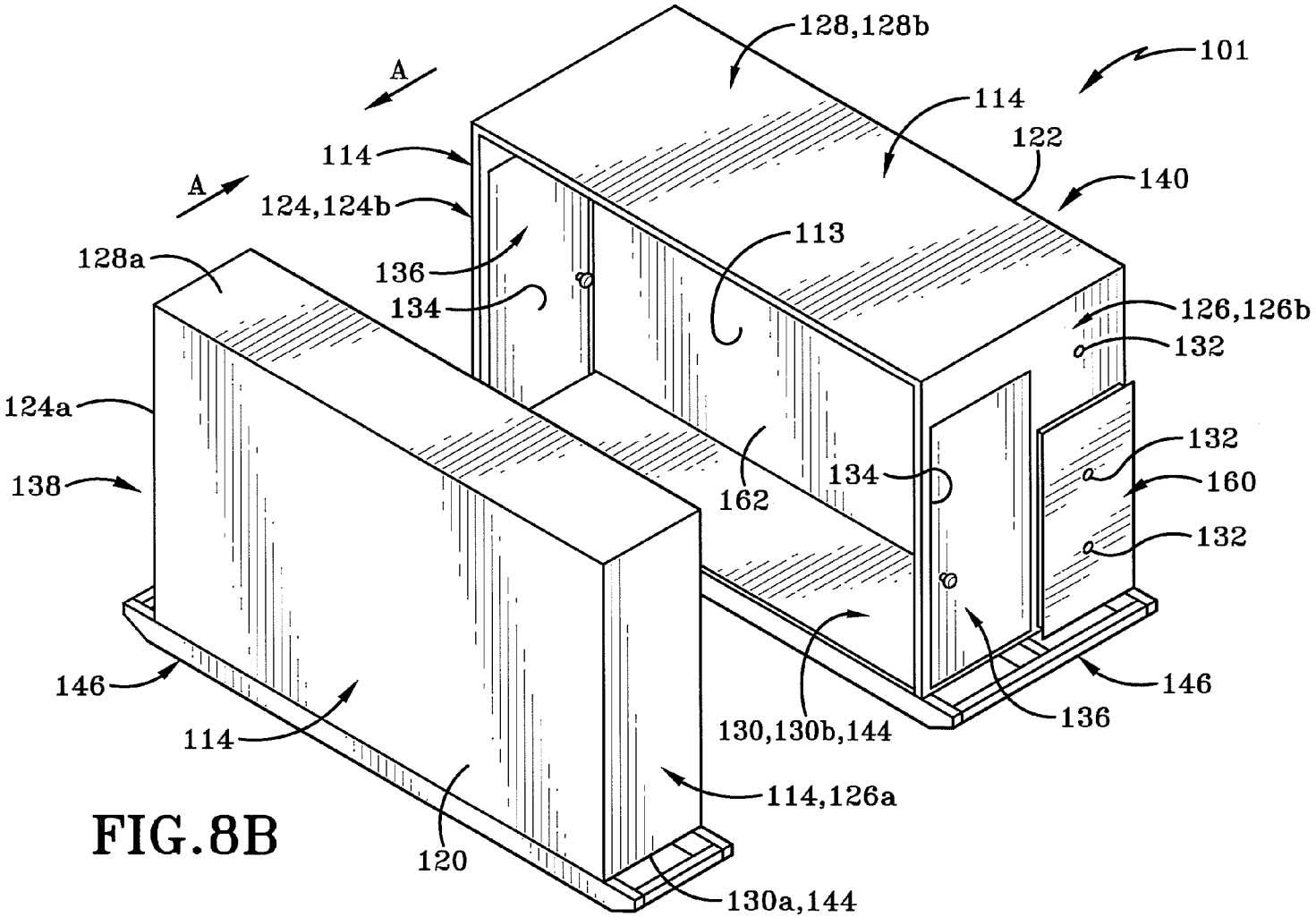
FIG. 8B is a perspective view of the housing in a separated state (i.e., an exploded perspective view) and depicting that two sections are joined together to form the assembled housing.

As detailed in FIG. 8A and FIG. 8B, housing 101 includes a left wall 120 spaced apart from a right wall 122 that therebetween define a lateral or transverse direction. Housing 101 further includes a first end wall 124 spaced apart from a second end wall 126 that therebetween define a longitudinal direction. Housing 101 further includes a top wall 128 spaced apart and opposite a bottom wall 130 therebetween defining a vertical direction. Walls 120, 122, 124, 126, 128, and 130 are joined together to form a general box-like structure therein defining chamber 113.

With continued reference to FIG. 8A and FIG. 8B, a plurality of apertures 132 may be formed in the walls permitting gas pipeline to extend therethrough. In one particular embodiment apertures 132 are shown formed in second end wall 126. However, it is clearly to be understood that apertures may be formed in any or each of the walls 120, 122, 124, 126, 128, and 130 as necessary to permit gas to flow into one of the vessels 50 or another component in chamber 113 of housing 101. An access opening 134 with a door 136 may also be formed in one of the walls permitting ingress and egress of a human operator into chamber 113.

As detailed in FIG. 8B, housing 101 includes a housing first section 138 and a housing second section 140. The respective housing sections 138, 140 are configured to be assembled separately and then joined together to create the box-like structure of housing 101. In one particular embodiment, housing first section 138 includes left wall 120, a first section 124*a* of first end wall 124, a first section 126*d* of second end wall 26, a first section 128*a* of top wall 128, and a first section 130*a* of bottom wall 130. First section 138 is joined to second section 140 along a housing seam union 142. Union seam 142 extends along a longitudinal plane from first end wall 124 to second end wall 126. Housing second section 140 includes right wall 122, a second section 124*b* of first end wall 124, a second section 126*b* of second end wall 126, a second section 128*b* of top wall 128, and a second section 130*b* of bottom wall 130.

As will be detailed further below, housing 101 is assembled in two sections 138, 140 to permit the stacked vessels 50 to be installed on floor surface above the single vessel footprint area within chamber 113 prior to housing 101 being joined and sealed along union seam 142. In one particular embodiment, assembled housing 101 may sit on or be supported by frame 146 to permit safe and sturdy transport of housing 101.

Figure 9:
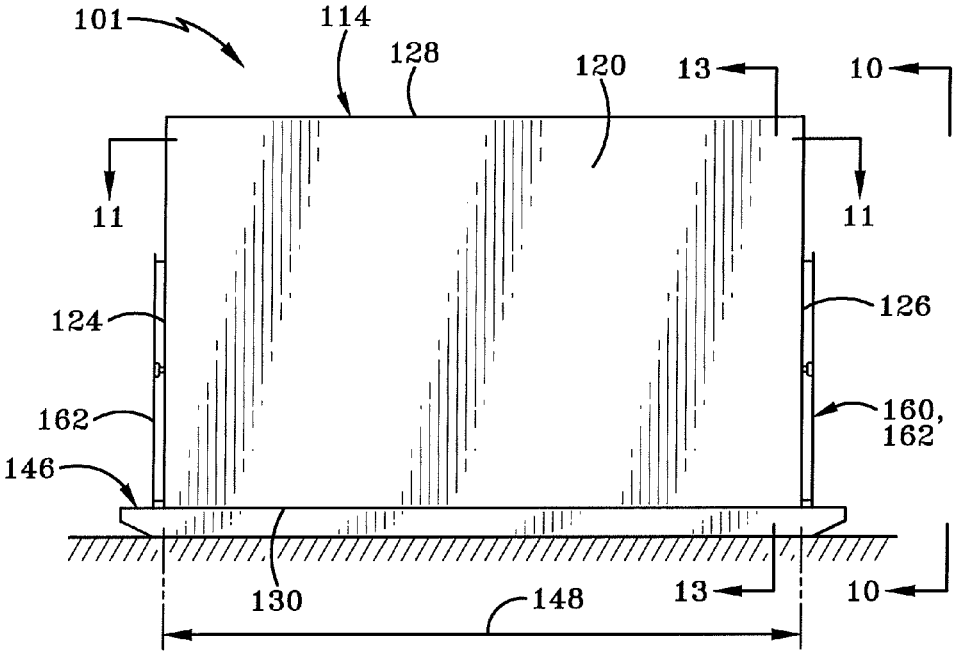
FIG. 9 is a left side elevation view of the housing.

A left side elevation view is detailed in FIG. 9. Left wall 120 extends vertically upwards from frame 146 towards top wall 128. Left wall 120 extends from first wall 124 longitudinally to second wall 126. The longitudinal axis of left wall 120 substantially defines the length of housing 101. Length 148 of housing 101 is long enough to retain two or three vertically stacked pressure vessels 50 such as particulate or gas separators as understood in the gas processing industry but shorter than any length prescribed as a maximum length for a commercial vehicle by the United States Department of Transportation Federal Highway Administration to permit transportation of the housing without the need for an Oversized Load Shipping Permit.

Figure 10:
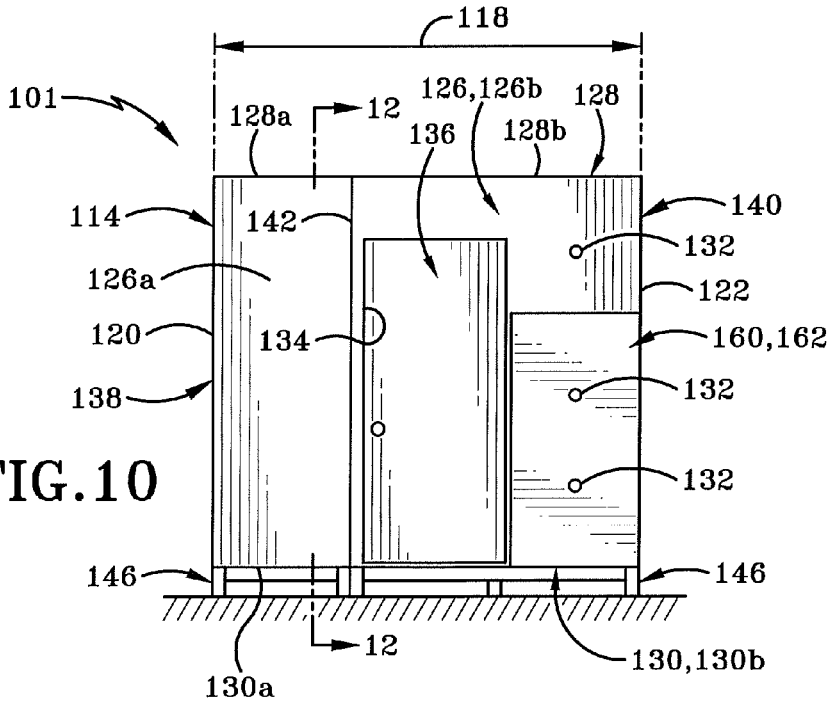
FIG. 10 is an end elevation view of the housing taken along line 10-10 in FIG. 9.

As detailed in FIG. 10, housing 101 has a width 118 measured laterally from left wall 120 to right wall 122. The housing width 118 being narrower than the maximum width for a commercial vehicle by the United States Department of Transportation Federal Highway Administration allows the transportation of housing 101 without the need for an Oversized Load Shipping Permit. Currently, the United Stated Department of Transportation Federal Highway Administration maximum width for a commercial vehicle is 112 inches. It is contemplated that generally the width 118 of housing 101 will be from about 85 inches to about 102 inches. More particularly in one embodiment, the width 118 of housing 101 is about 96 inches. One exemplary non-limiting advantage of having width 118 be about 96 inches is that it is wide enough to allow a human to enter chamber 113 through door 136 to service vessels 50, but still narrow enough to require vessels 50 to be arranged in a stacked configuration.

Figure 11:
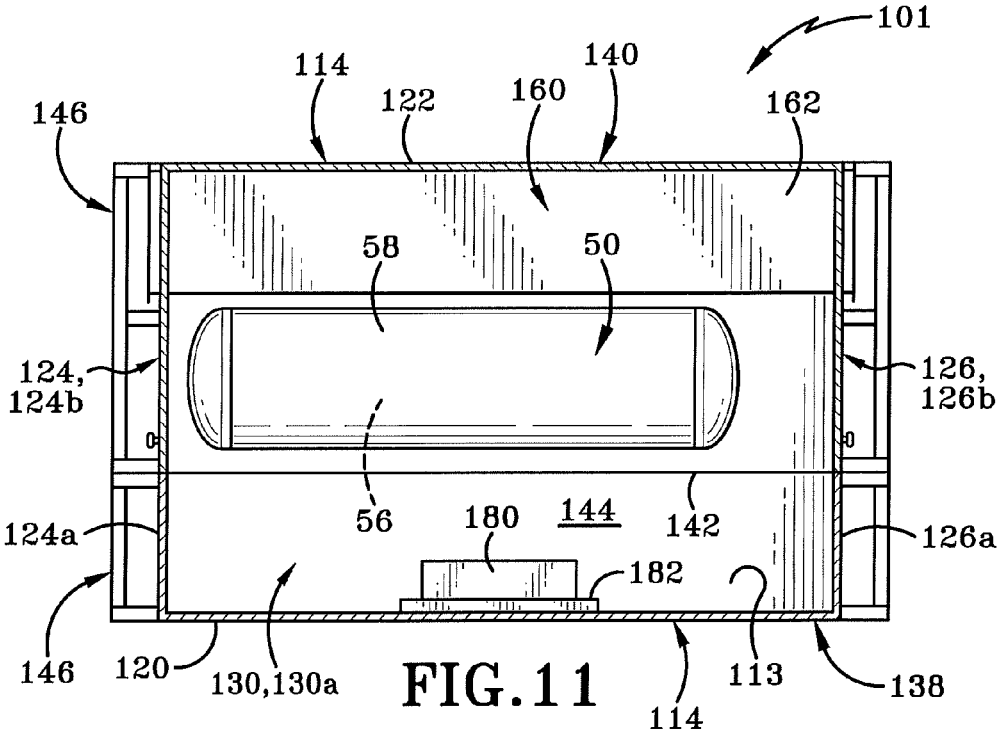
FIG. 11 is a top section view taken along line 11-11 in FIG. 9.
Figure 12:
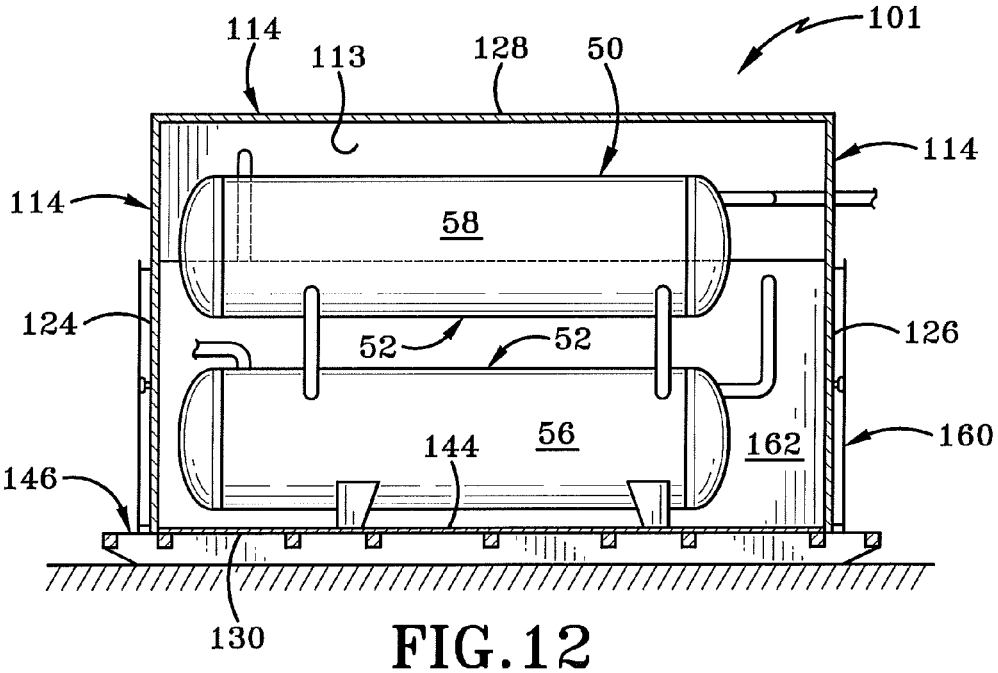
FIG. 12 is a side section view taken along line 12-12 in FIG. 10.
Figure 13:
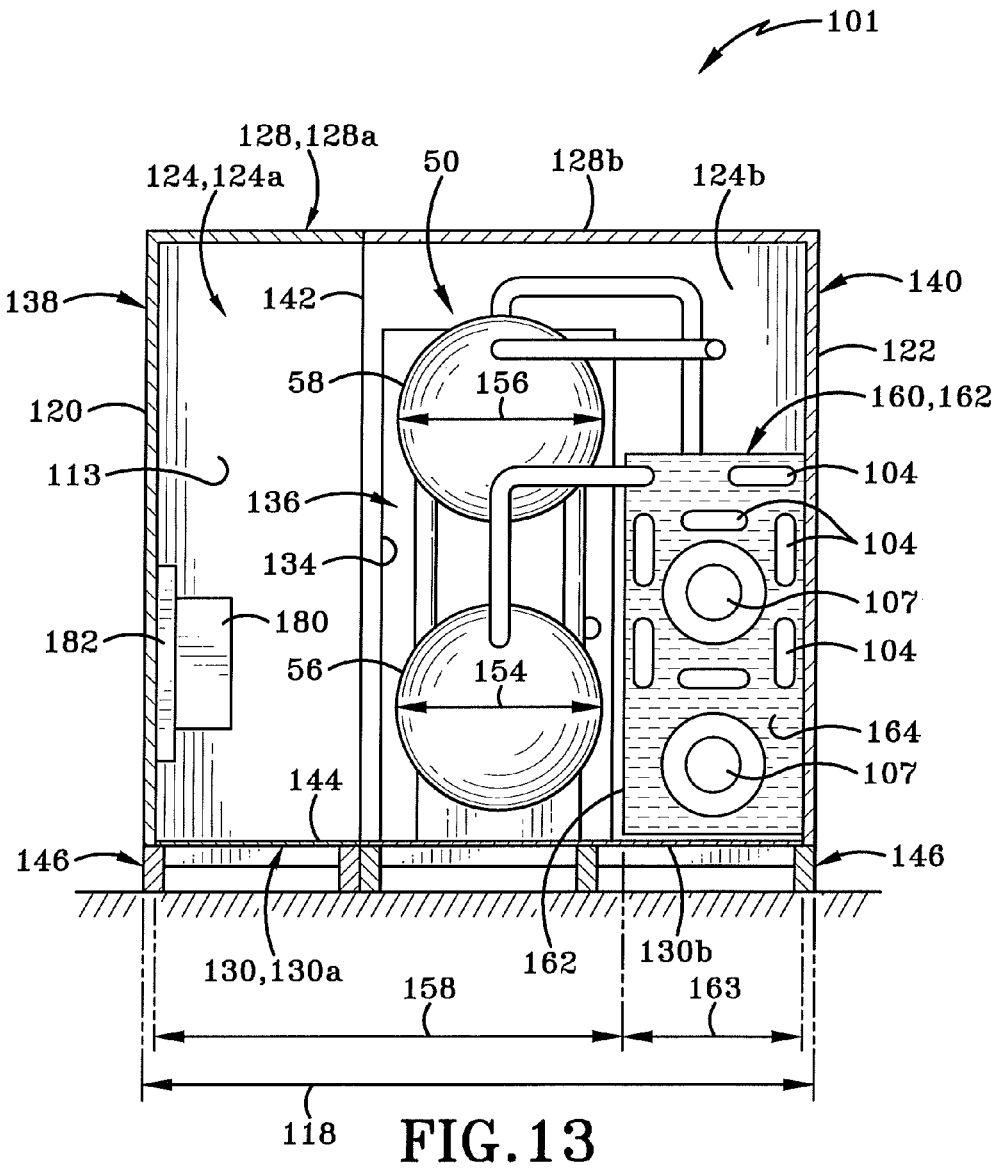
FIG. 13 is an end section view taken along line 13-13 in FIG. 9.

With respect to the section views detailed in FIG. 11, FIG. 12, and FIG. 13, housing 101 houses the pair of pressure vessels 50 in chamber 113. In one particular embodiment, pressure vessels 50 include the first separator 56, and the second separator 58. First and second separators 56, 58 are stacked in a vertical configuration. When viewed from the end, as in FIG. 6, first vessel 56 has a width 154 and second vessel 58 has a width 156. The present disclosure is configured to house the stacked separators 56, 58 above the floor space 144 having a width 158. Floor width 158 is less than the sum of first and second separator widths 154, 156. Stated otherwise, if separators 56, 58 were arranged in a side-by-side configuration, floor width 158 would be less than the width of the two side-by-side separators 56, 58. Stacked configuration allows housing 101 to be transported on a conventional tractor-trailer device as overall housing width 118 is less than the Federal Highway maximum as described above.

With continued reference to FIGS. 11-13, a gas processing heat exchanging unit 160 (also referred to as heat exchanger 160) may also be included within chamber 113 on housing 101. Heat exchanger 160 includes heat exchanging container wall 162 extending from front end 124 extending longitudinally towards and connecting with second end 126. A fluid filled chamber 164 is defined by heat exchanger 160. Chamber 164 includes heat exchanging pipeline extending and winding in a serpentine manner therein to heat fuel moving through pipeline 104 along the flow stream of the gas processing system. Heat exchanger 160 has a width 163 that extends from container wall 162 to left wall 122. Heat exchanger width 163 defines a portion of housing width 118. Further, heat exchanger width 163 plus floor width 158 substantially define housing width 118.

As depicted in FIG. 11, a control system 180 is adjacent one of the housing walls configured to operate the at least two gas processing pressure vessels 50. A mounting bracket 182 connects the control system 180 to an inner surface on one of the housing walls to dispose the control system 180 within the chamber. Control system 180 may include gas processing logic to actuate a valve to send gas through one of the stacked separators 50. "Logic", as used herein, includes but is not limited to hardware, firmware, software and/or combinations of each and a computer to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

Figure 14:
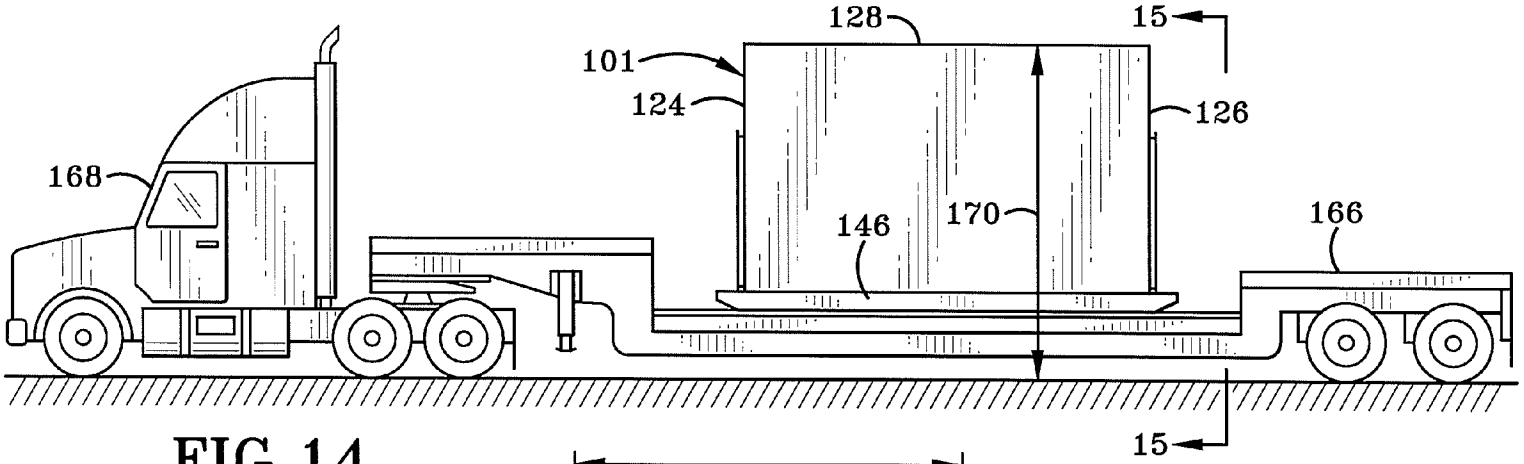
FIG. 14 is an environmental left side view of the housing on a trailer towed by a tractor-truck atop a trailer for shipment.
Figure 15:
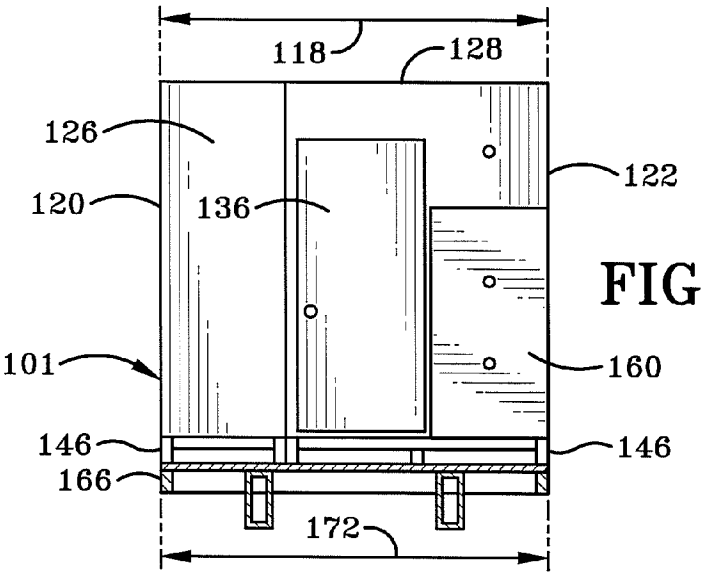
FIG. 15 is an end section view taken along line 15-15 in FIG. 14 depicting the housing on the trailer having a width less than the federal maximum for a commercial vehicle.

With reference to FIG. 14 and FIG. 15, housing 101 is shown in a transportation environmental side view and cross section end view respectively. Housing 101 is configured to be transported on a trailer 166, towed by tractor-truck or vehicle 168. When housing 101 is on trailer 166 for shipment, the height 170 of the loaded housing 101 on trailer 166 is preferably less than about 14 feet measured from the ground to the top of the housing 101 on trailer 166. One exemplary non-limiting purpose is that, generally heights less than about 14 feet maybe moved along the Federal Highway System. In one particular embodiment, the height of housing 101 itself measured from floor 144 to top wall 128 is from about 100 inches to about 115 inches and even further, in the shown embodiment, housing height from floor 144 to top 128 is 108½ inches. Trailer width 172 is equal to or narrower than the United States Department of Transportation Federal Highway Administration maximum for a commercial vehicle (112 inches at the time of this disclosure). Further, as shown in one particular embodiment (FIG. 15), housing width 118 may be substantially equal or similar to trailer width 172.

In accordance with one aspect of an embodiment of the present disclosure, housing 101 permits a supplier within the oil and gas processing fields to provide a housing for a two separator system that is transportable along the Federal Highways without the need for a special Oversized Load Permit. This is extremely advantageous for shipping costs which ultimately reduces cost to the end consumer.

While it is contemplated that walls 120, 122, 124, 126, 128, and 130 used to construct housing 101 will be constructed from heavy steel ordinarily used in the gas processing housing industry, other materials may suffice to provide adequate security for storing the complex gas processing components contained inside chamber 113.

In operation, housing 101 is constructed by providing first section 138 and second section 140 in pre-assembled form. First section 138 is constructed by welding partial sections 124*a*, 126*a*, 128*a*, and 130*a* to left wall 120. Second section 40 is constructed by welding partial sections 124*b*, 126*b*, 128*b*, and 130*b* to right wall 122. First section 138 and second section 140 are longitudinally aligned such that their interior chambers are facing each other. With the chambers aligned, the vertically stacked pressure vessels 50 are installed on the floor space 144 in either one of the first section 138 or the second section 140. The two sections 138, 140 are moved laterally inwards in the direction of Arrow(s) A (FIG. 8B) towards each other mating a long union seam 142.

When the two sections 138, 140 are in a mated position (FIG. 8A), manufacturer welds or otherwise joins sections 138, 140 together along union seam 142. While it is contemplated that the manner in which sections 138, 140 are joined is via weld, clearly other means of coupling section 38, 40 together such as rivets or bolts are entirely possible.

Once the structure of housing 101 has been assembled (FIG. 8A), pipeline may be connected to ensure the pressure vessels or the separators work as designed. In one particular embodiment, first and second separators 56, 58 are aligned and connected via pipeline in a series configuration with the heater being connected via pipeline in series between the two separators 56, 58.

In operation and with respect to transportation/shipment, housing 101 is loaded onto trailer 166 and towed or hauled by truck 168 to an end destination, such as a gas production well site. The transporting of the housing 101 on a road is done without the need for an oversized load shipping permit. In one particular embodiment, the end destination is a well site for extracting fossil fuel such as natural gas. As previously discussed, the transport of housing 101 on trailer 166 does not require any special permit because the width 118 of housing 101 is narrower than the federal maximum width for transporting goods via a commercial vehicle on the highway. By way of non-limiting example, this is advantageous as the two vessels 50 are necessary for the gas processing operation occurring at the end destination or the well site.

After transportation and shipment has been completed and housing 101 has been unloaded and placed adjacent a well site, housing 101 operates by processing gas incoming through the inlet and flowing into the first separator 56 where fuel is separated from non-fuels. The fuels may be sent to a downstream pipeline, and the other matter may flow into heat exchanger 160 to be heated and then sent via pipeline to second separator 58 where any fuel remaining is separated out a second time and sent to a downstream destination such as a sales pipeline.

Further, when housing is deposited at a site location an operator may enter the chamber 113 through the door 136 formed in a sidewall of the housing. The operator may then contact a component on a control system 180 to actuate an element (e.g. a valve) along a pipeline to manipulate gas in the pipeline. Alternatively, after depositing the housing having the stacked pressure vessels therein at a site location, an element may be actuated along a pipeline in communication with the two pressure vessels remotely via a control system 180 mounted to the housing.

As depicted in FIG. 16 through FIG. 23B, another exemplary gas processing system is presented in accordance with the present disclosure and is generally depicted at 200. System 200 includes a gas production unit 202, a plurality of sand separators 204, and a plurality of fossil fuel producing wells 206 located at a well site.

Figure 16:
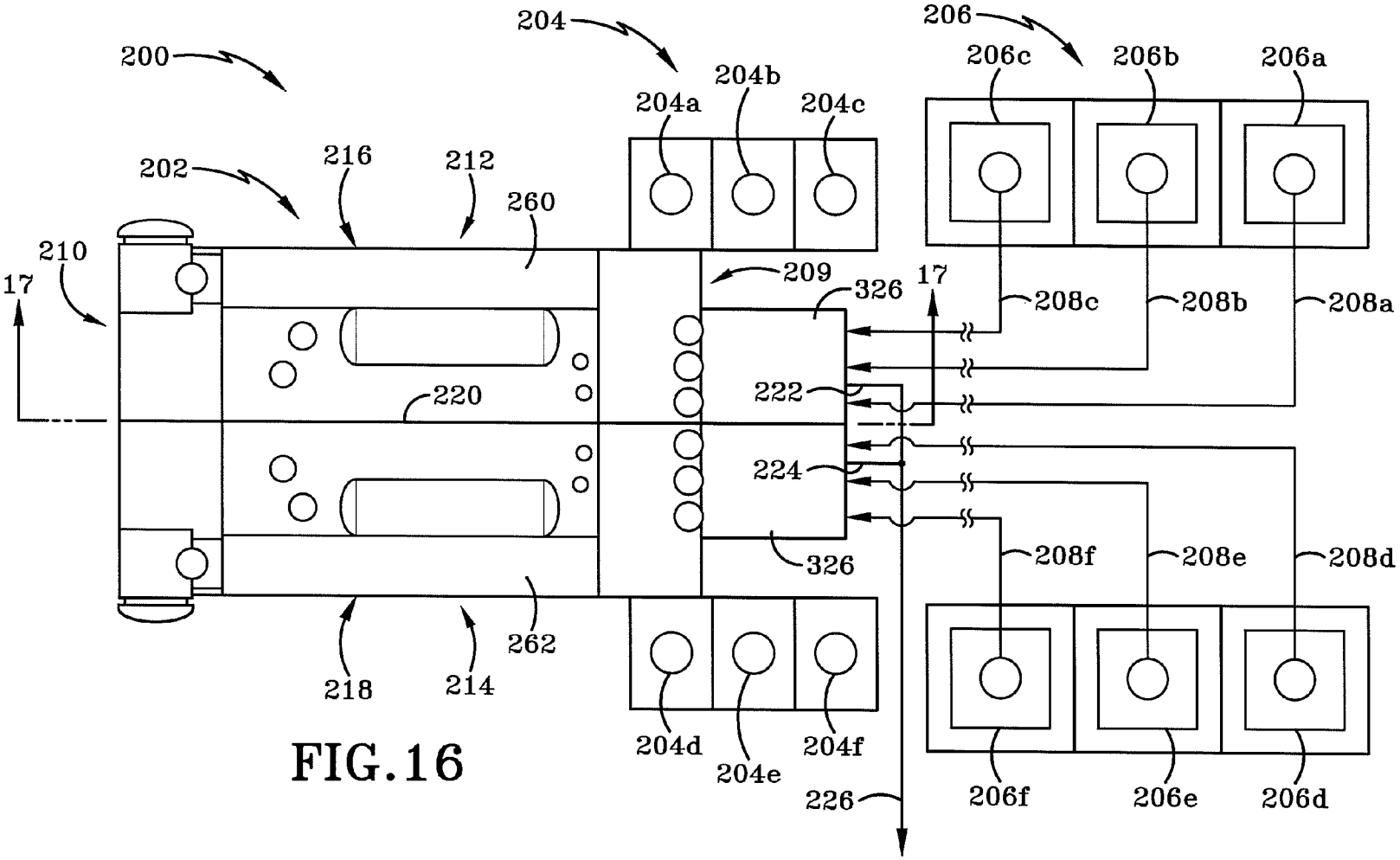
FIG. 16 is top schematic view of a well site layout including an exemplary embodiment of a gas production unit having two sets of three vertically stacked gas separators, each set of three separators housed within its own housing and each separator in fluid communication with a respective gas production well, depicting six total wells.

As depicted in FIG. 16, gas production unit 202 includes a first end 209 opposite a second end 210 defining a longitudinal direction therebetween. Production unit 202 includes a first side 212 opposite a second 214 defining a transverse or lateral direction therebetween. Gas production unit includes a first modular unit, or first module, 216 and a second modular unit, or second module, 218. First module 216 and second module 218 are arranged side by side and adjoined to each other at a longitudinally extending junction 220 such that the first module 216 defines the first side 212 and the second module 218 defines second side 214.

A plurality of sand separators 204 are operatively connected to gas production unit 202 via a pipeline. The plurality of sand separators 204 includes a first sand separator 204*a*, a second sand separator 204*b*, a third sand separator 204*c*, a fourth sand separator 204*d*, a fifth sand separator 204*e*, and a sixth sand separator 204*f*. A first sand separator, second sand separator, and third sand separator 204*a*, 204*b*, and 204*c*, are connected to first module 216. The fourth sand separator, the fifth sand separator, and the sixth sand separator 204*d*, 204*e*, and 204*f*, are connected to second module 218. Generally, each respective sand separator is connected to a single gas separator housed within one of the modules that each collectively define a portion of a gas flow pathway as will be described in greater detail below. Stated otherwise, in this embodiment, the wells and gas processing devices are distinct and their pipelines are not connected in series. Rather, they are connected in parallel operation and merge at a downstream destination, such as a sales pipeline 22B.

The plurality of wells 206 includes a first well 206*a*, a second well 206*b*, a third well 206*c*, a fourth well 206*d*, a fifth well 206*e*, and a sixth well 206*f*. First well 206*a* produces fossil fuel and is operatively connected to either the first sand separator 204*a* or a first gas separator within first module 216. Pipeline 208*a* feeds wet well head gas along a first gas flow pathway towards either first sand separator 204*a* or the first module 216. A second set of pipeline 208*b* connects second well 206*b* producing fossil fuel to either the second sand separator 204*b* or a second gas separator within the first module 216. A third set of pipeline 208*c* connects fossil fuel producing third well 206*c* to either the third sand separator 204*c* or a third gas separator within the first module 216. A fourth set of pipeline 208*d* connects the fourth fossil fuel producing well 206*d* to either the fourth sand separator 204*d* or a fourth gas separator within the second module 218. A fifth set of pipeline 208*e* connects the fifth fossil fuel producing well 206*e* to either the fifth sand separator 204*e* or a fifth gas separator within the second module 218. A sixth set of pipeline 208*f* connects the sixth fossil fuel producing well 206*f* to either the sixth sand separator 204*f* or a sixth gas separator within the second module 218.

As described in greater detail below, after the gas separators contained in each of the first module 216 and the second module 218 separate the fossil fuel from the non-fuel constituents, clean fossil fuel is output from the first module 216 along first output 222 and clean output gas is output from second output 224 from second module 218. The first output 222 and the second output 224 are combined together in an overall combined output pipeline 226 which may be transferred to a downstream destination such as a sales pipeline or a storage holding tank.

Figure 16A:
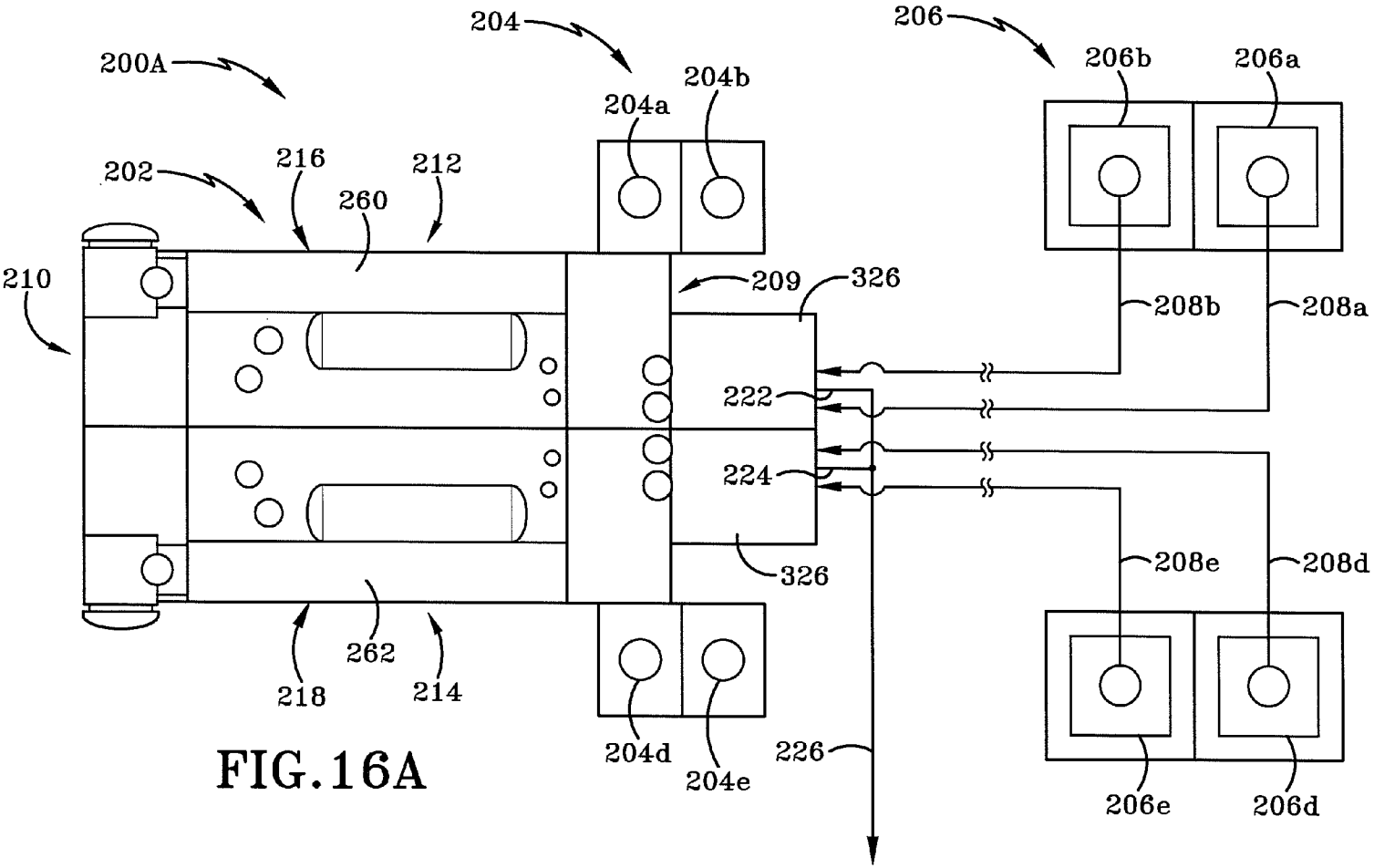
FIG. 16A is top schematic view of a well site layout including an exemplary embodiment of another gas production unit having two sets of two vertically stacked gas separators, each set of two separators housed within its own housing and each separator in fluid communication with a respective gas production well, depicting four total wells.

As depicted in FIG. 16A, an alternative embodiment of the gas processing system 200 is identified generally at 200A. System 200A is similar to gas processing system 200 but rather than having six sets of wells, six sand separators, and six gas separators within the first and second modules, there exists only four wells, four sand separators, and four gas separators in the first and second modules. System 200A is depicted to indicate that while system 200 utilizes six wells, six sand separators, and six gas separators in two production units, any number of wells, sand separators, and gas separators may be used in accordance with the present disclosure.

Figures 17, 17A:
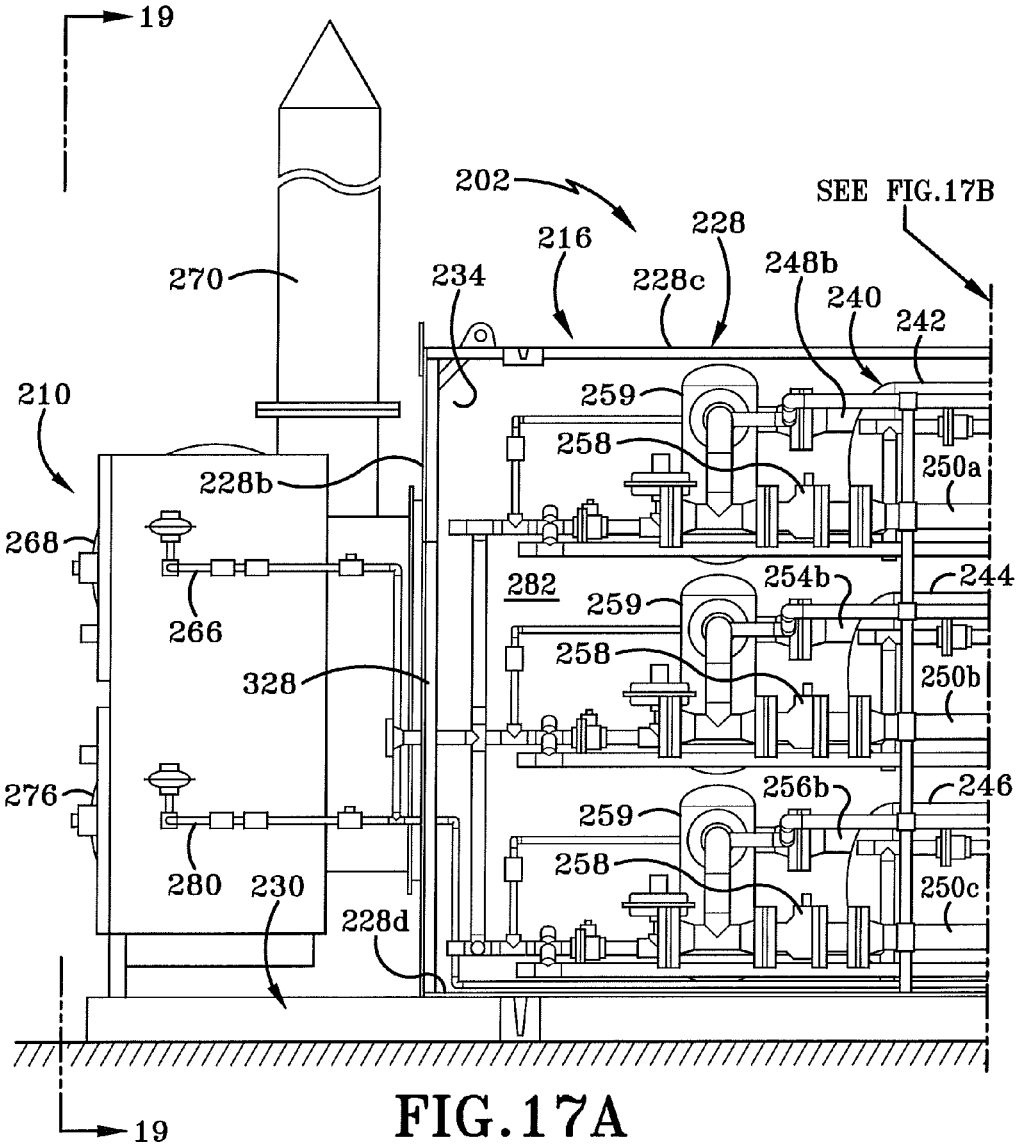
FIG. 17 is a representation depicting that the side views of FIG. 17A, FIG. 17B, and FIG. 17C are to be viewed collectively and arranged left-to-right to produce a large composite side view of the gas production unit.
FIG. 17A is a partial side view of one end of the gas production unit to be viewed collectively with FIG. 17B and FIG. 17C.
Figure 17B:
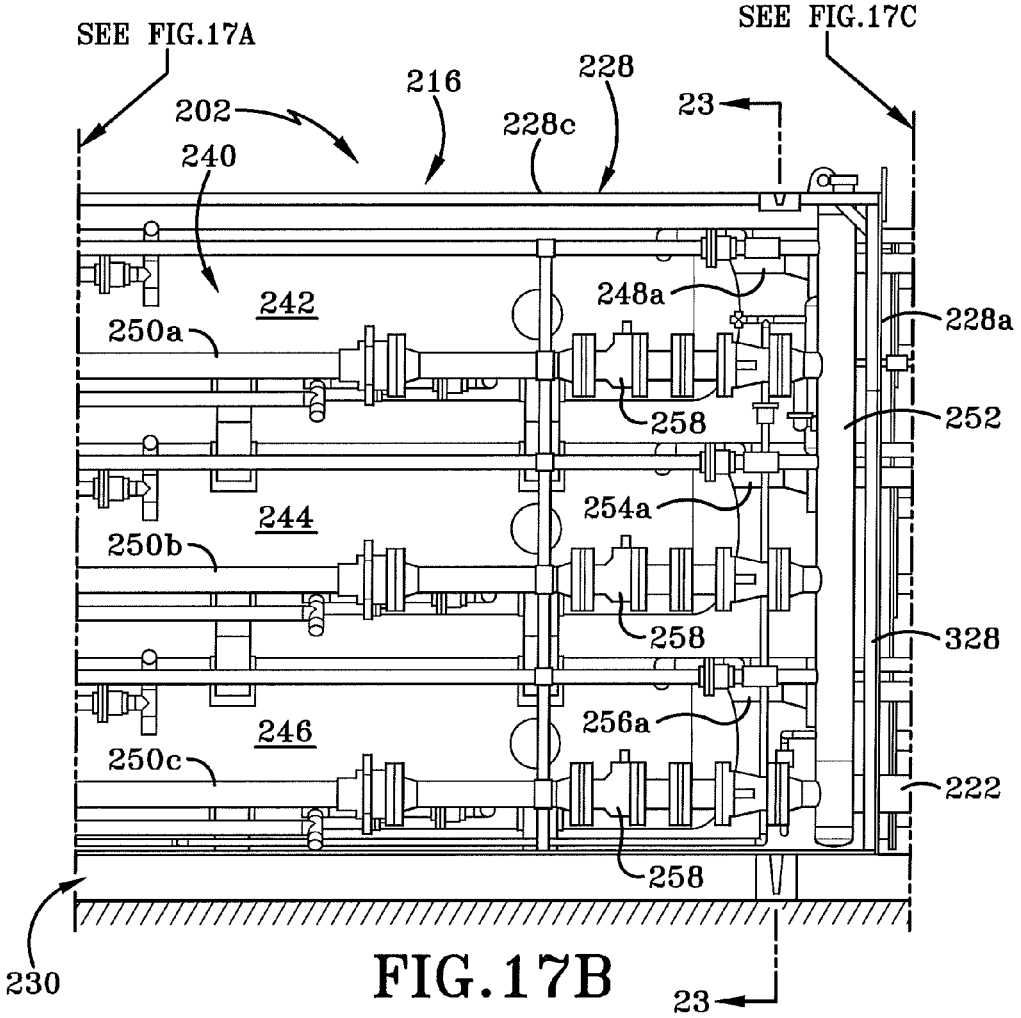
FIG. 17B is a partial side view of the mid-section of the gas production unit to be viewed collectively with FIG. 17A and FIG. 17C.
Figure 17C:
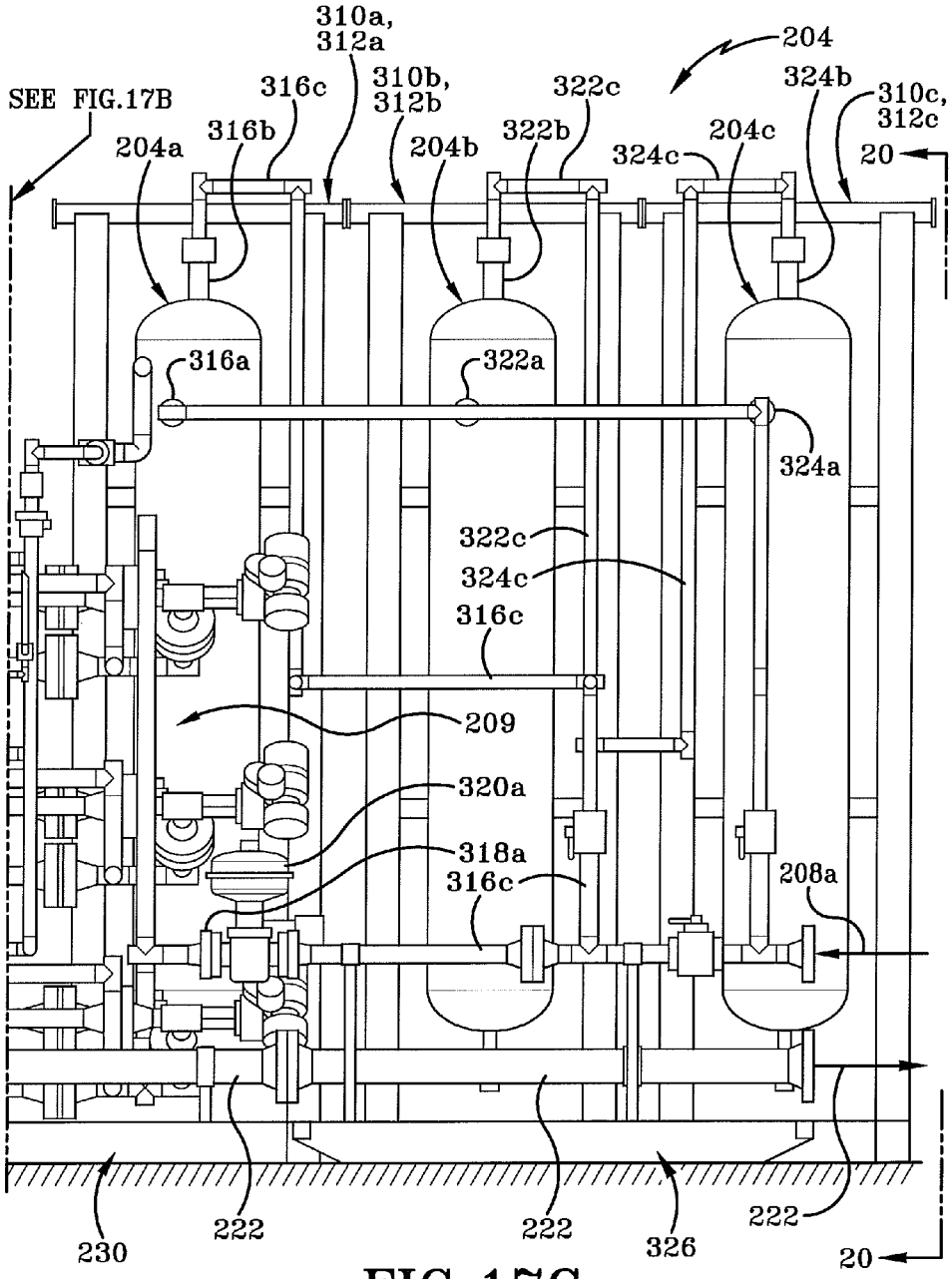
FIG. 17C is a partial side view of an opposite end of the gas production unit to be viewed collectively with FIG. 17A and FIG. 17B.

FIG. 17 is a schematic representation depicting that the side elevation views of FIG. 17A, FIG. 17B, and FIG. 17C are to be viewed collectively and arranged in a side to side manner. In keeping with this, the descriptions made herein will be made with reference to FIG. 17A, FIG. 17B, and FIG. 17C.

As depicted in FIG. 17A, FIG. 17B, and FIG. 17C, the first module 216 of gas production unit 202 includes a plurality of connected outer walls 228 defining a box-like configuration generally similar to that identified in the previous embodiments of FIG. 1 through FIG. 15. Housing walls 228 are supported by a skid frame 230 having a length extending from first end 209 to second end 210. Skid frame 230 has a width 232 (FIG. 21) extending from junction 220 to first side 212. The width 232 is sized to fit upon a traditional flatbed trailer 166 towed by a truck 168. The advantage of width 232 being sized to fit upon a traditional flatbed trailer 166 is that it allows first module 216 to be towed by a truck 168 without the need for an oversize load shipping permit from any state, federal, or local agency overseeing highway or roadway regulations.

Housing walls 228 supported by frame 230 generally include five walls arranged in a box-like manner wherein one longitudinal wall is absent. Particularly, a first end wall 228*a* is opposite a second end wall 228*b*, a top wall 228*c* is opposite a bottom wall 228*d*, and first sidewall 228*e* is opposite an opening to the inner chamber 234 defined by the plurality of connected housing walls 228.

Gas production unit 202 includes a plurality of stacked separators 240 within chamber 234 above bottom wall 228 and supported by skid frame 230. A plurality of stacked separators 240 are directly vertically aligned above each other defining a stacked configuration that was previously identified in general versions with respect to FIG. 1 through FIG. 15. The first set of the plurality of stacked separators 240 are associated with first module 216. It is to be understood that second module 218 has another set of stacked separators identical to those identified in FIG. 17 but are not shown in the longitudinal cross section view. The plurality of stacked separators 240 in first module 216 include an upper first separator 242, an intermediate second separator 244, and a lower third separator 246. Each of these respective separators is coupled to a single well defining their respective gas flow pathways. For example, first well 206*a* is connected via pipeline 208*a* to upper first separator 242, second well 206*b* is connected via pipeline 208*b* to intermediate second separator 244, and third well 206*c* is connected via pipeline 208*c* to lower third separator 246.

Each of the separators 242, 244, and 246, have respective inlets and outlets. A first separator inlet 248*a* permits fossil fuels flowing into first separator 242 and first separator outlet 248*b* carries the separated and extracted fossil fuels out from first separator 242. A first set of outlet piping 250*a* carries fossil fuel separated in first separator 242 to a combining pipeline 252. The respective flow stream pathways from well 206*a*, well 206*b*, and well 206*c* converge in combining and blending pipeline 252. Notably, each of these respective pathways from a given well remain independent from each other until the gas reaches combining pipeline 252 which is downstream from each respective outlet on the plurality of stacked separators 240.

Intermediate second separator 244 includes an inlet 254*a* and an outlet 254*b*. Outlet 254*b* is connected to outlet pipeline 250*b* which connects the intermediate second separator 244 to combining and blending pipeline 252. Combining and blending pipeline 252 is downstream from outlet 254*b* on intermediate second separator 244. Lower third separator 246 includes an inlet 256*a* and an outlet 256*b*. Outlet 256*b* is coupled to outlet piping 250*c* which is connected to combining pipeline 252. Combining pipeline 252 is downstream from outlet 256*b* on lower third separator 246.

As is understood in the art, a plurality of valves 258 or secondary filters 259 may be incorporated along the respective outlet discharge pathways of first separator 242, second separator 244, and third separator 246 between their respective outlets and their outlet piping.

Combining pipeline 252 is depicted as positioned within chamber 234 adjacent first end 208. However, it is clearly contemplated that this position is not a limitation on system 200, as one having ordinary skill in the art could easily understand that combining pipeline 252 could be located outside of first module 216. It may be alternatively be possible to position a combining pipeline upstream from the respective inlets of the plurality of stacked separators and include a manifold device to send combined fossil fuel stream pathways through any one of the stacked separators 242, 244, and 246.

Reference is now made to a first heat exchanger unit which is part of first module 216. First heat exchanger unit 260 on first module 216 is opposite a second heat exchanging unit 262 on module 218. The description of first heat exchanger 260 will apply in a similar fashion to second heat exchanger 262. However, for brevity purposes, only first heat exchanger 260 is described with the understanding that the second module 218 operates in a similar manner to that of first module 216.

First heat exchanger 260 includes at least heat source, at least one fuel line 266, at least one air intake duct 268, at least one exhaust stack 270, at least one fluid filled chamber 272, and at least one serpentine pipeline 274. Shown throughout this disclosure, the at least one heat source is identified as burner tube 264 burning fuel from line 266, however, it is entirely possible that other types of heat sources may be used, such as electrical resistance heat, chemical reactive heat, or others.

As generally seen throughout the figures, first heat exchanger 260 is generally associated with first side 212 of gas production unit 202 on first module 216. However, it is clearly understood that the position of first heat exchanger 260 may be varied according to driller needs and gas processing system 200 will still accomplish its broad goals disclosed herein.

Figures 18, 18A:
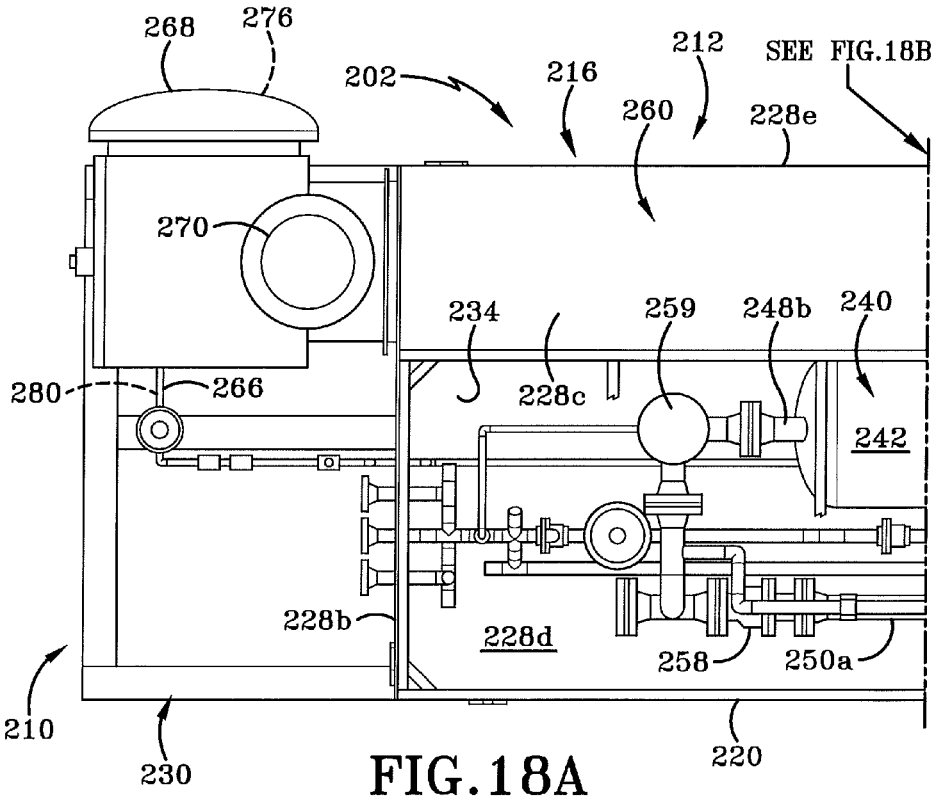
FIG. 18 is a representation depicting that the top views of FIG. 18A, FIG. 18B, and FIG. 18C are to be viewed collectively and arranged left-to-right to produce a large composite top view of the gas production unit.
FIG. 18A is a partial top view of one end of the gas production unit to be viewed collectively with FIG. 18B and FIG. 18C.
Figure 18B:
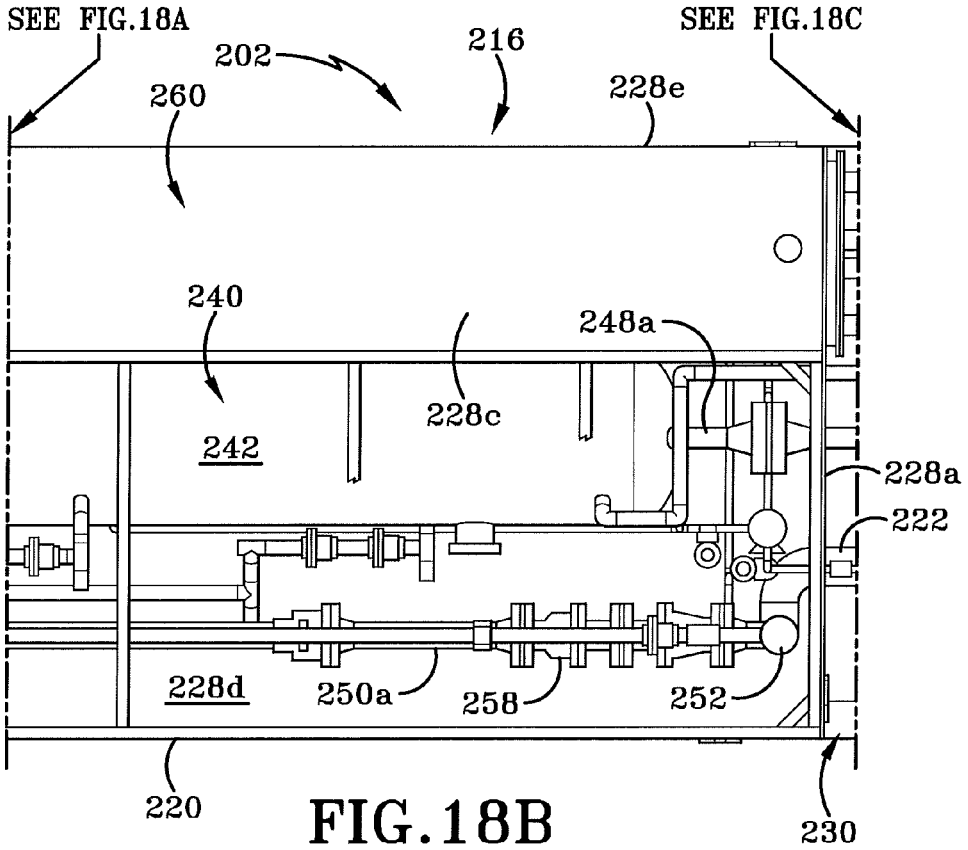
FIG. 18B is a partial top view of the mid-section of the gas production unit to be viewed collectively with FIG. 18A and FIG. 18C.
Figure 19:
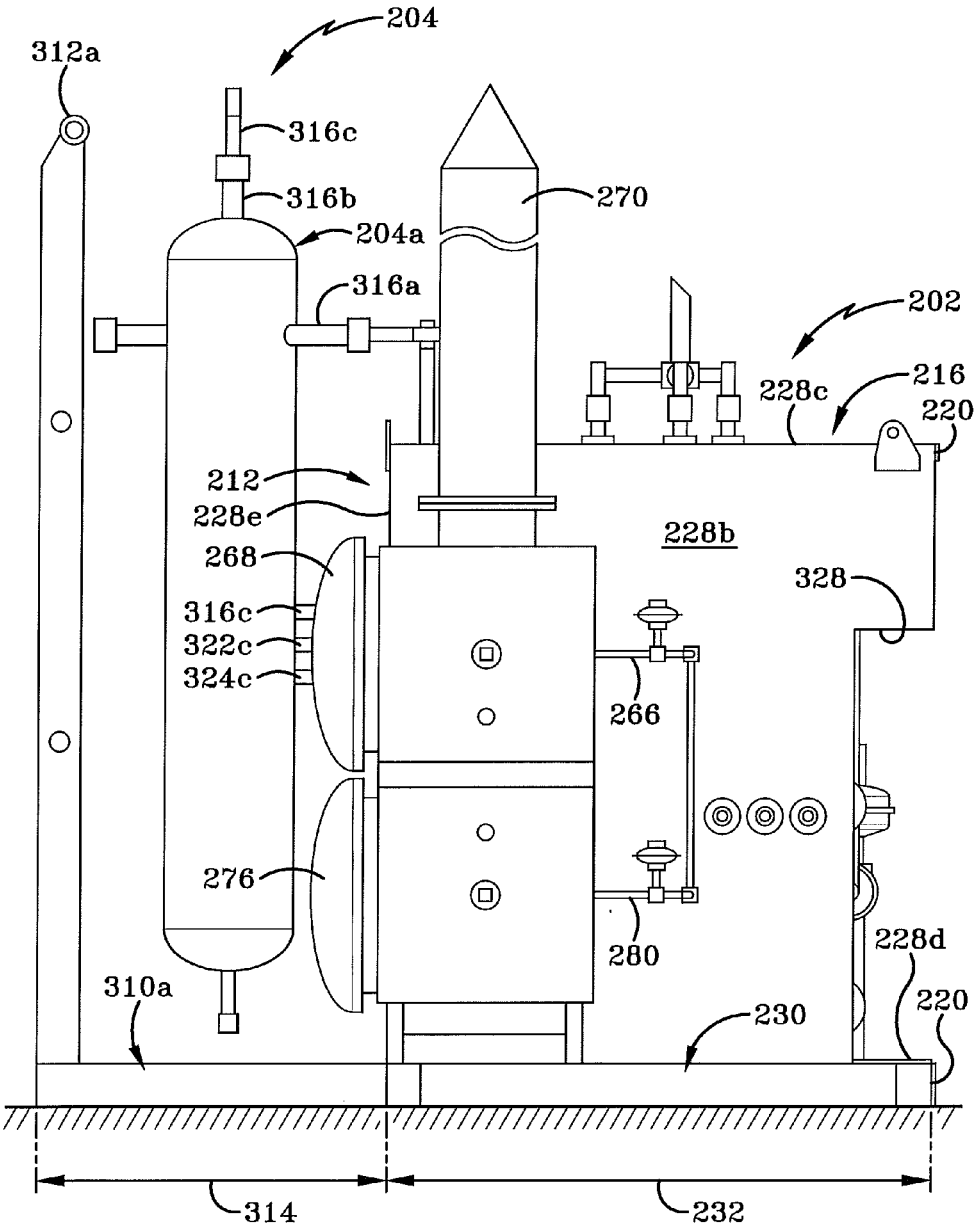
FIG. 19 is an end view taken along line 19-19 in FIG. 17A.

As depicted in FIG. 17A, FIG. 18A, and FIG. 19, the at least one air intake 268 and the at least one exhaust stack 270 are positioned outside of chamber 234 beyond wall 228B while still supported by skid frame 230. Gas production unit 202 may further include a second air intake 276 positioned directly below the at least one air intake 268. With continued reference to FIG. 19, a second burner tube 278 is fed with a second fuel line 280. Second burner tube 278 is submerged within the fluid filled chamber 272 directly below the at least one burner tube 264.

Figure 23:
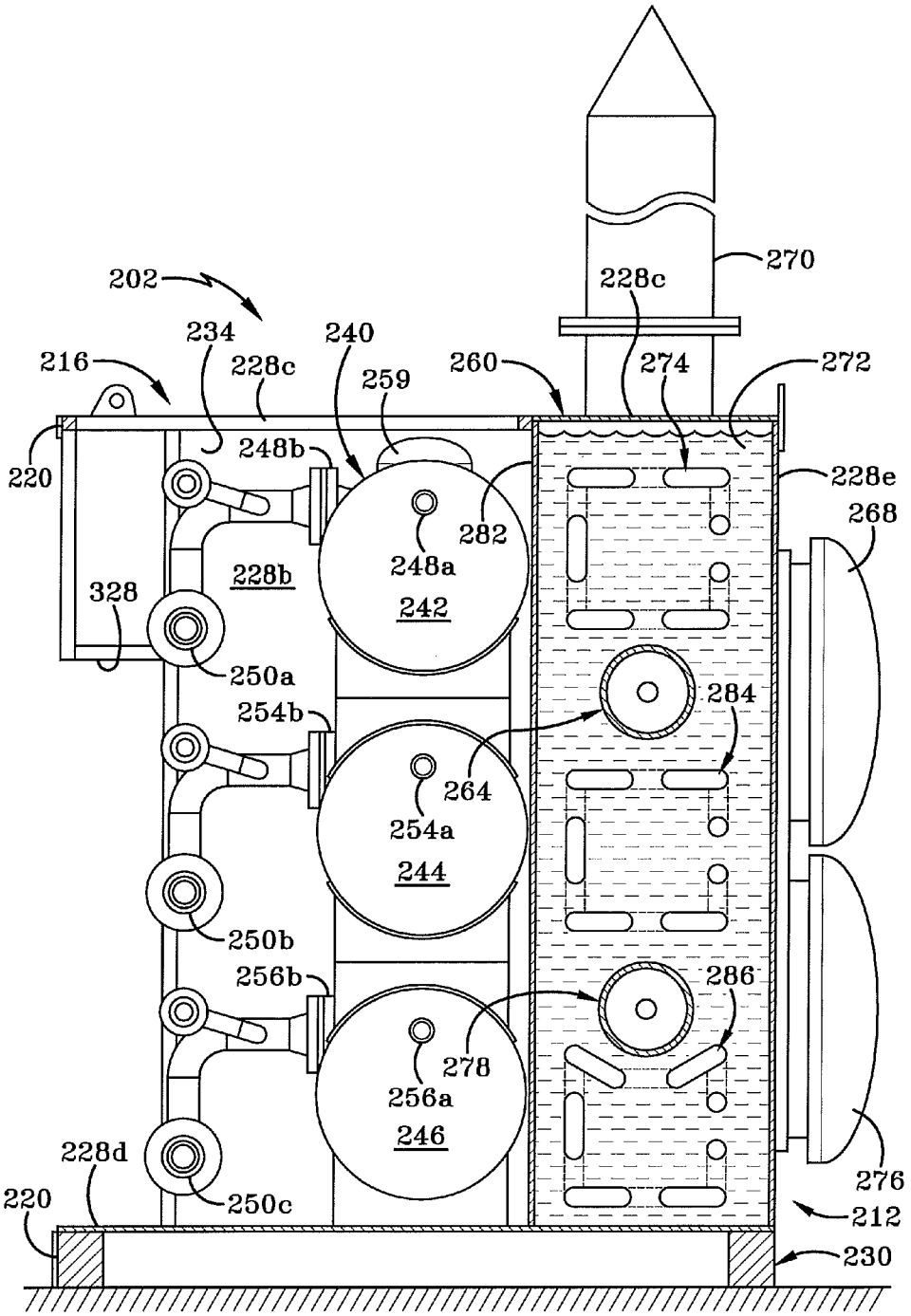
FIG. 23 is a vertical cross section taken along line 23-23 in FIG. 17B depicting three stacked separators and heat exchanging pipeline submerged in fluid inside the heat exchanger.

As depicted in FIG. 23, fluid filled chamber 272 may extend vertically from mostly adjacent top wall 228*c* to bottom wall 228*d*. Chamber 272 is bound by a portion of top wall 228*c*, a portion of bottom wall 228*d*, first wall 228*e*, and a chamber wall 282 which is located near the mid-portion of width 232 of first module 216. The plurality of stacked separators 240 are positioned closely adjacent chamber wall 282 and their direct vertical alignment is best seen in FIG. 23.

With continued reference to FIG. 23, the at least one serpentine winding and heat exchanging pipeline 274 submerged in the fluid of fluid filled chamber 272 is depicted as being in an upper portion of the fluid filled chamber 272 above first burner tube 264. The at least one serpentine heat exchanging pipeline 274 is a portion of the gas flow pathway extending from first wall 206*a* along pipeline 208*a* then into serpentine pipeline 274 then into first gas separator 242. Stated otherwise, the at least one serpentine heat exchanging pipeline 274 is associated with first gas separator 242 and its fuel contents flowing downstream do not mix with the other serpentine heat exchanging pipeline which will be described in greater detail below.

A second serpentine heat exchanging pipeline 284 and a third serpentine heat exchanging pipeline 286 are provided within the fluid filled chamber. Second serpentine heat exchanging pipeline 284 is positioned between first burner tube 264 and second burner tube 278. The second serpentine heat exchanging pipeline is associated with the second separator 244 and is configured to keep gas warm as it expands and prevents freezing as the fossil fuel moves downstream from second well 206*b* towards second separator 244. Similarly, third serpentine heat exchanging pipeline 286 is a heat exchanging pipeline submerged in the bath that is associated with third well 206*c* and third separator 246. The third set of heat exchanging serpentine pipeline 286 is positioned at the lowest portion of the fluid filled chamber 272 closely adjacent bottom wall 228 and beneath both the first burner tube 264 and the second burner tube 278. Pipelines 274, 284, and 286 keep gas moving therethrough warm as the gas expands and decreases pressure therein to prevent the gas and pipes from freezing.

Figure 22:
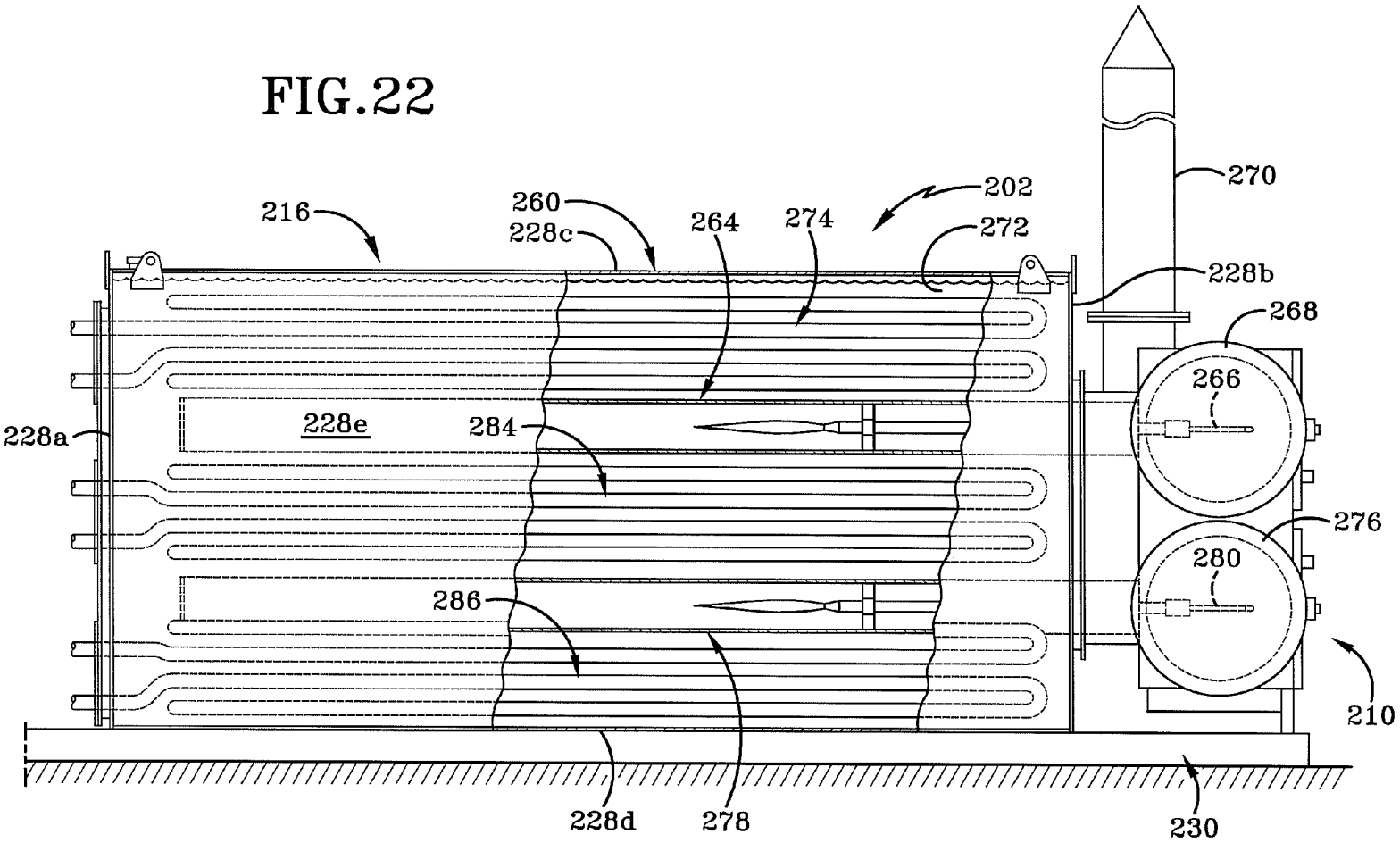
FIG. 22 is a cross section view of a heat exchanger fluid bath in one embodiment.
Figure 22A:
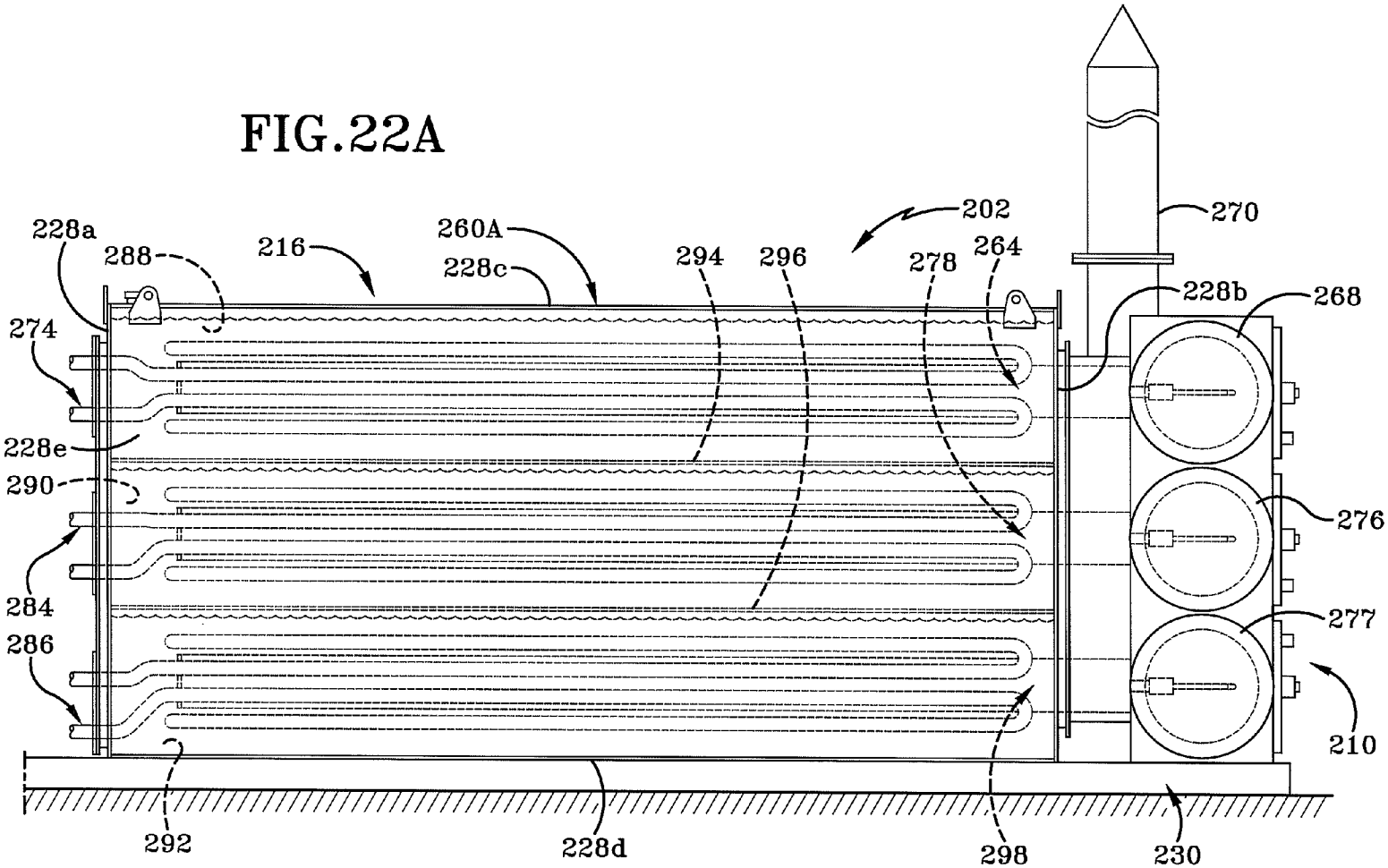
FIG. 22A is a cross section view of a heat exchanger fluid bath in another embodiment.
Figure 23A:
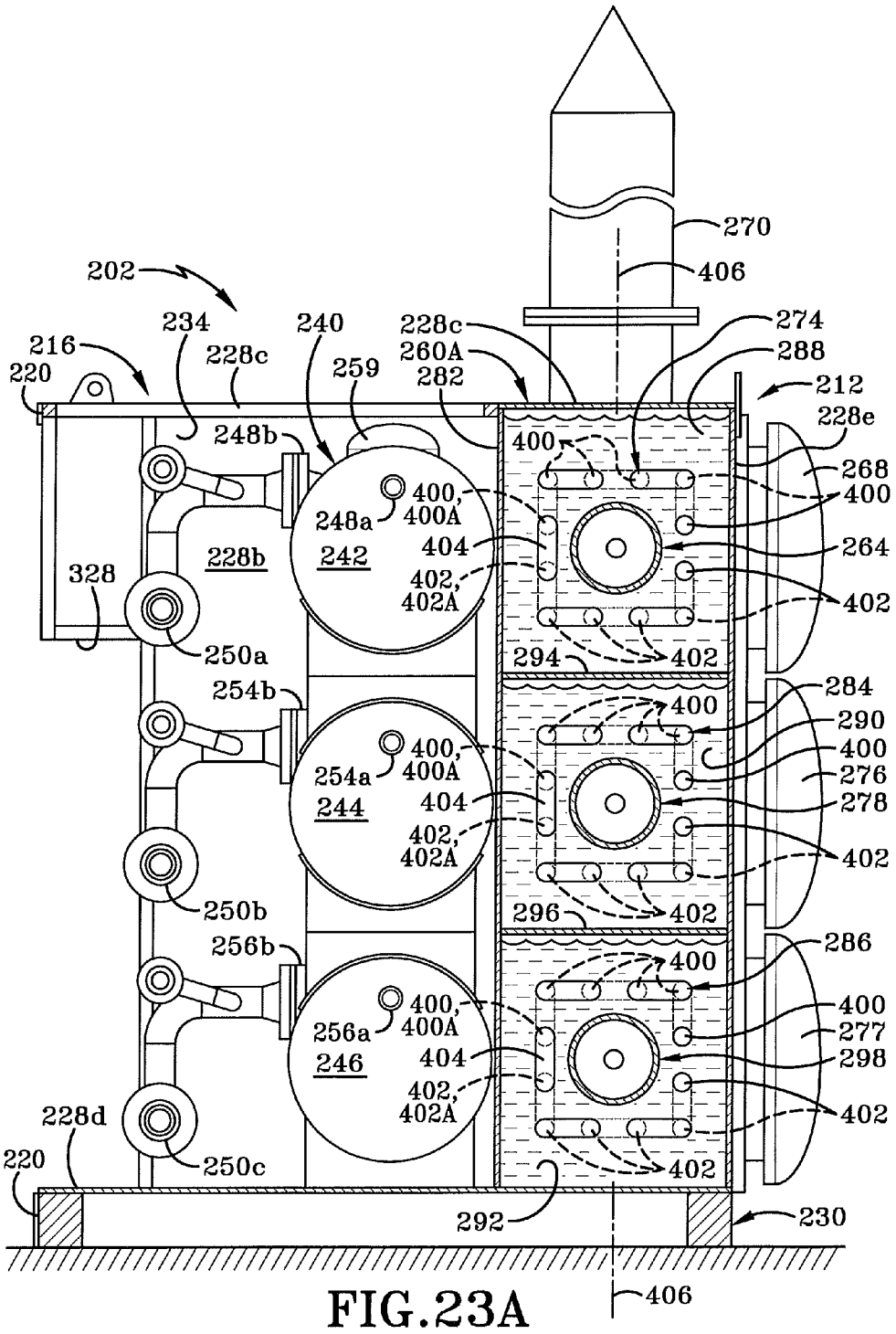
FIG. 23A is a vertical cross section of another embodiment of heat exchanger taken along a line similar to 23-23 in FIG. 17B depicting three stacked separators and heat exchanging pipeline submerged in independent fluid chambers inside the heat exchanger.

As depicted in FIG. 22A and FIG. 23A, an alternative embodiment may include a heat exchanger 260A including a plurality of separate and distinct fluid filled chambers. Particularly, a first fluid filled chamber 288, a second fluid filled chamber 290, and a third fluid filled chamber 292. First fluid filled chamber 288 is separated from second fluid filled chamber 290 by a rigid first wall 294. Second fluid filled chamber 290 is separated from third fluid filled chamber 292 by a second wall 296. Wall 294 and wall 296 ensure that the fluid within the respective three chambers do not mix. Heat exchanger 260A may include a plurality of burner tubes equal to the number of fluid filled chambers such that a single burner tube is disposed within a single chamber. As shown in FIG. 22A and FIG. 23A, three burner tubes are provided. A first burner tube 264 is submerged within first fluid filled chamber 288 adjacent first set of heat exchanging serpentine pipeline 274. A second burner tube 278 is submerged within second fluid filled chamber 290 adjacent second set of heat exchanging serpentine pipeline 284. A third burner tube 298 is submerged within third fluid filled chamber 292 adjacent third set of heat exchanging serpentine pipeline 286. Third air intake 277 feeds air to third burner tube 298. The overall number of air intakes may equal that of the number of burner tubes. Each one of the three burner tubes 264, 278, 298 may burn its own fuel source. Each one of the three burner tubes 264, 278, 298 may intersect a vertically aligned central plane 406 associated with heat exchanger 260A centered between wall 282 and wall 228*e*.

Each burner tube heats the fluid within each distinct chamber to warm the fossil fuel moving downstream through the serpentine pipeline submerged within the fluid of that chamber as the gas expands and decreases pressure. For example, as fossil fuel moves downstream from the first well 206*a* along pipeline 208*a* and through the sand separator 204*a*, the fossil fuel then enters first fluid filled chamber 288 within the first set of heat exchanging serpentine pipeline 274. The first burner tube 264 submerged within the distinctly filled fluid chamber 288 warms the fluid in which heat exchanging serpentine pipeline 274 is submerged. As pressure in the fluid moving downstream along serpentine pipeline 274 is lowered, the heated fluid prevents the fossil fuel moving within pipeline 274 from freezing as the pressure is decreased.

With continued reference to FIG. 23A, the first set of serpentine pipeline 274 of heat exchanger 260A may include a plurality of pre-heat pipe segments 400 and a plurality of expansion pipe segments 402. The plurality of pre-heat pipe segments 400 are connected fluidly in series and include an ultimate pre-heat segment 400A. The plurality of expansion pipe segments 402 are connected fluidly in series and include an initial expansion segment 402A. The ultimate pre-heat segment 400A is fluidly coupled serially upstream to the initial expansion segment 402A via coupling transitional member or coupler 404. In some embodiments the amount of pre-heat pipe segments may be in a range from four to eight pipe segments 400, and in one particular embodiment there are six pre-heat pipe segments 400 (see FIG. 23A). Additionally, the amount of expansion segments may also be in a range from four to eight pipe segments 402, and in one particular embodiment there are six expansion pipe segments 402 (see FIG. 23A). It is contemplated that the number of pre-heat segments 400 equals the number of expansion segments 402 (in the shown instance there are six), however this configuration may change as needed. For example, in other embodiments it may be necessary to have less pre-heat segments and more expansion segments to assist with the fossil fuel processing, and in this instance there may be four pre-heat segments and eight expansion segments. In another example, another embodiments may require to have more pre-heat segments and less expansion segments to assist with the fossil fuel processing, and in this instance there may be eight pre-heat segments and four expansion segments. Thus, it is clearly foreseeable that the number of pre-heat and expansion segments may vary to accomplish the desired amount of fossil fuel processing as one having ordinary skill in the art would understand and foresee. In some other embodiments, the plurality of expansion pipe segments may be positioned farther from the heat source than the plurality of pre-heat pipe segments. And in other embodiments, the plurality of expansion pipe segments may be closer to the heat source than the plurality of pre-heat pipe segments Additionally, while segments 400 and segments 402 were described above with reference to the first set of serpentine pipeline 274 of heat exchanger 260A, it is to be clearly understood that the second set of serpentine pipeline 284 of heat exchanger 260A and the third set of serpentine pipeline 286 of heat exchanger 260A also have similar configurations of pre-heat segments and expansion segments for their respective fossil fuel processing pathways.

Figure 23B:
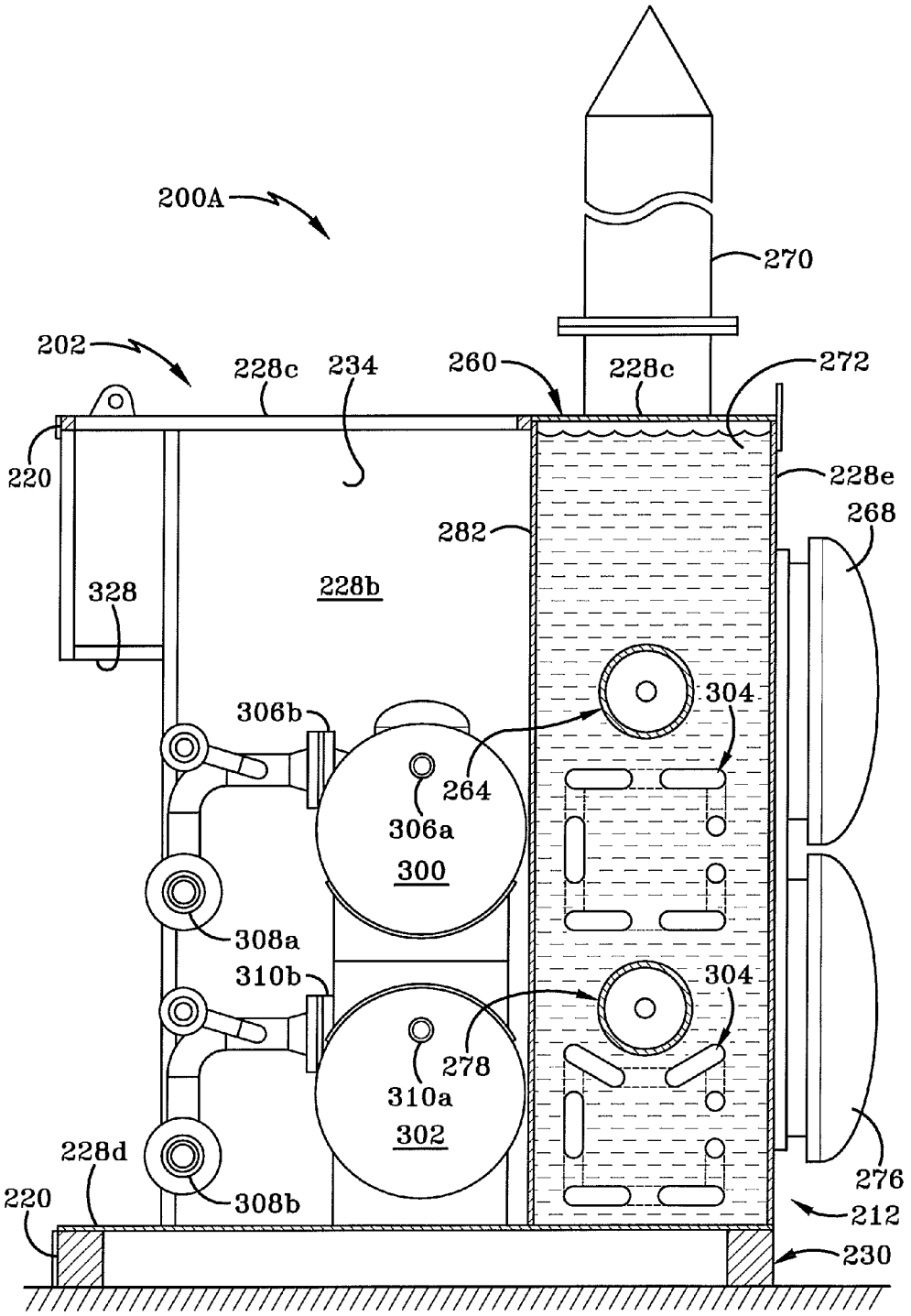
FIG. 23B is a vertical cross section of another embodiment of heat exchanger taken along a line similar to 23-23 in FIG. 17B depicting two stacked separators and heat exchanging pipeline submerged inside the heat exchanger.

As depicted in FIG. 23B, gas production unit 202 may include an embodiment where only two gas separators are stacked within each modular unit. Particularly, system 200A includes a first separator 300 and a second separator 302 stacked vertically above one another. In this embodiment, only two sets of serpentine pipeline are contained within fluid filled chamber 272. Particularly, a first heat exchanging serpentine pipeline 304 finds a pathway in fluid communication with an inlet 306*a* of first separator 300 and an outlet 306*a*. Outlet 306*a* may be in fluid communication with outlet piping 308*a* which can lead downstream to another combining pipeline similar to that of combining pipeline 252. The second separator 302 of system 200A is directly below first separator 300 and includes an inlet 310*a* and an outlet 310*a*. Outlet 310*a* is in fluid communication with outlet piping 308B which leads downstream to a combining pipeline similar to that of combining pipeline 252.

System 200 may include one or more fluid pumps or impellers or propellers to keep the fluid moving within the heat exchangers. This assists with even heat distribution.

Figure 18C:
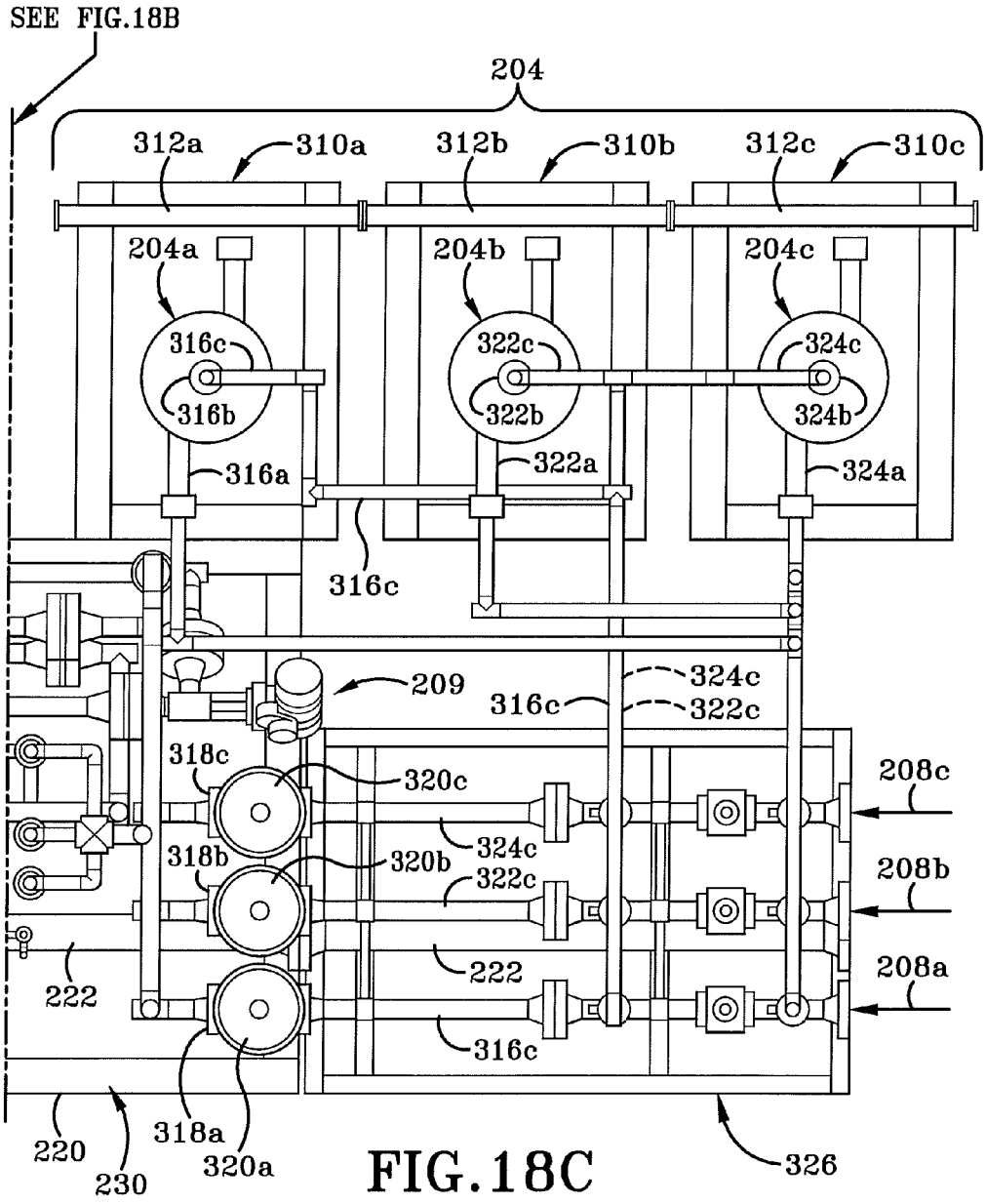
FIG. 18C is a partial side view of an opposite end of the gas production unit to be viewed collectively with FIG. 18A and FIG. 18B.

Turning back to FIG. 17C and FIG. 18C, first module 216 of gas production unit 202 may be operatively connected to the plurality of sand separators 204. First sand separator 204*a* may be supported by a frame 310*a*, second sand separator 204*b* may be supported by a second frame 310*b*, and third sand separator 204*c* may be supported by a third frame 310*c*. Each of the sand separating frames may be coupled together via a rigid longitudinally extending cross member 312*a*, 312*b*, 312*c* securing the frames together.

Figure 20:
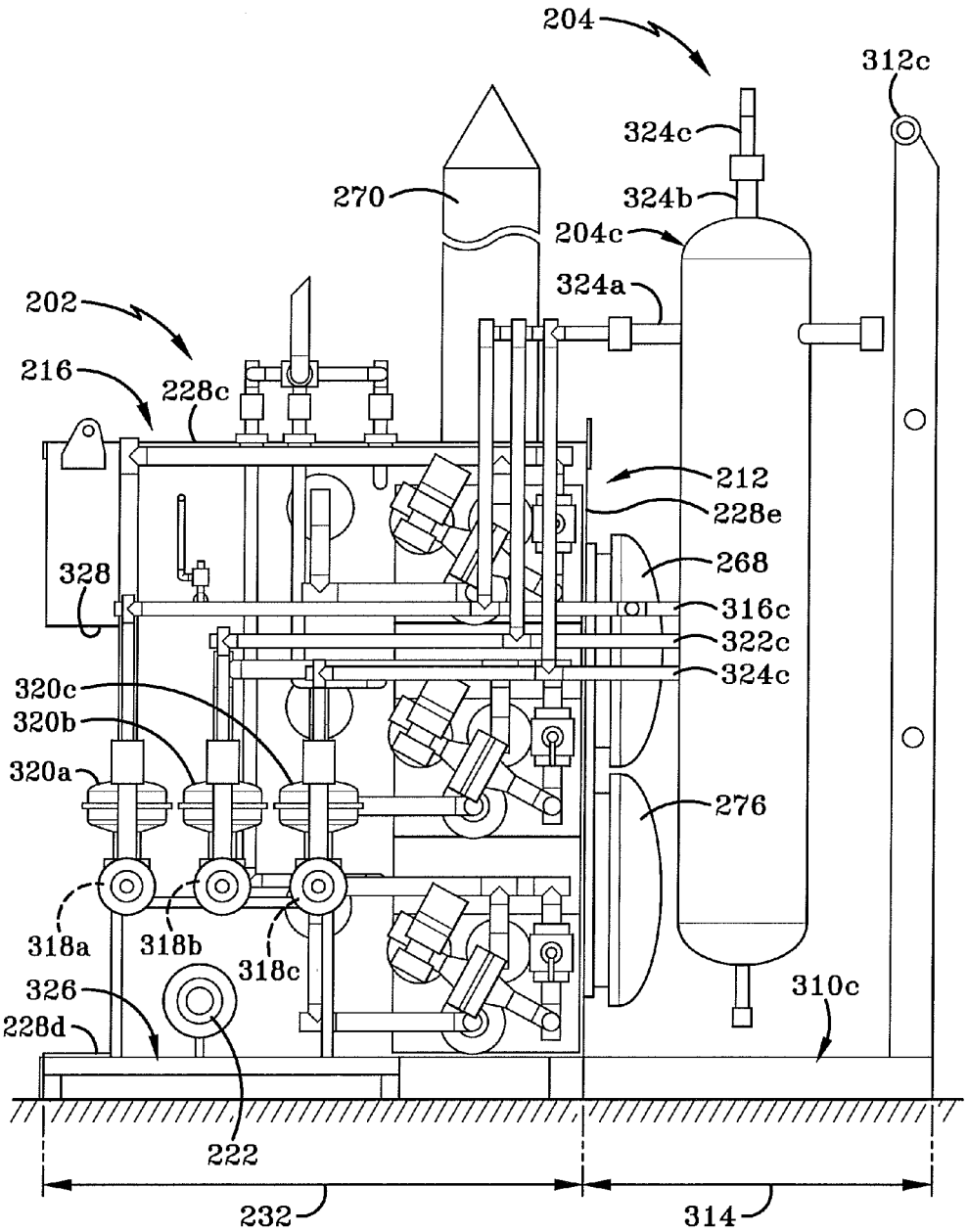
FIG. 20 is an opposite end view taken along line 20-20 in FIG. 17C depicting a set of sand separators connected to the gas production unit.
Figure 21:
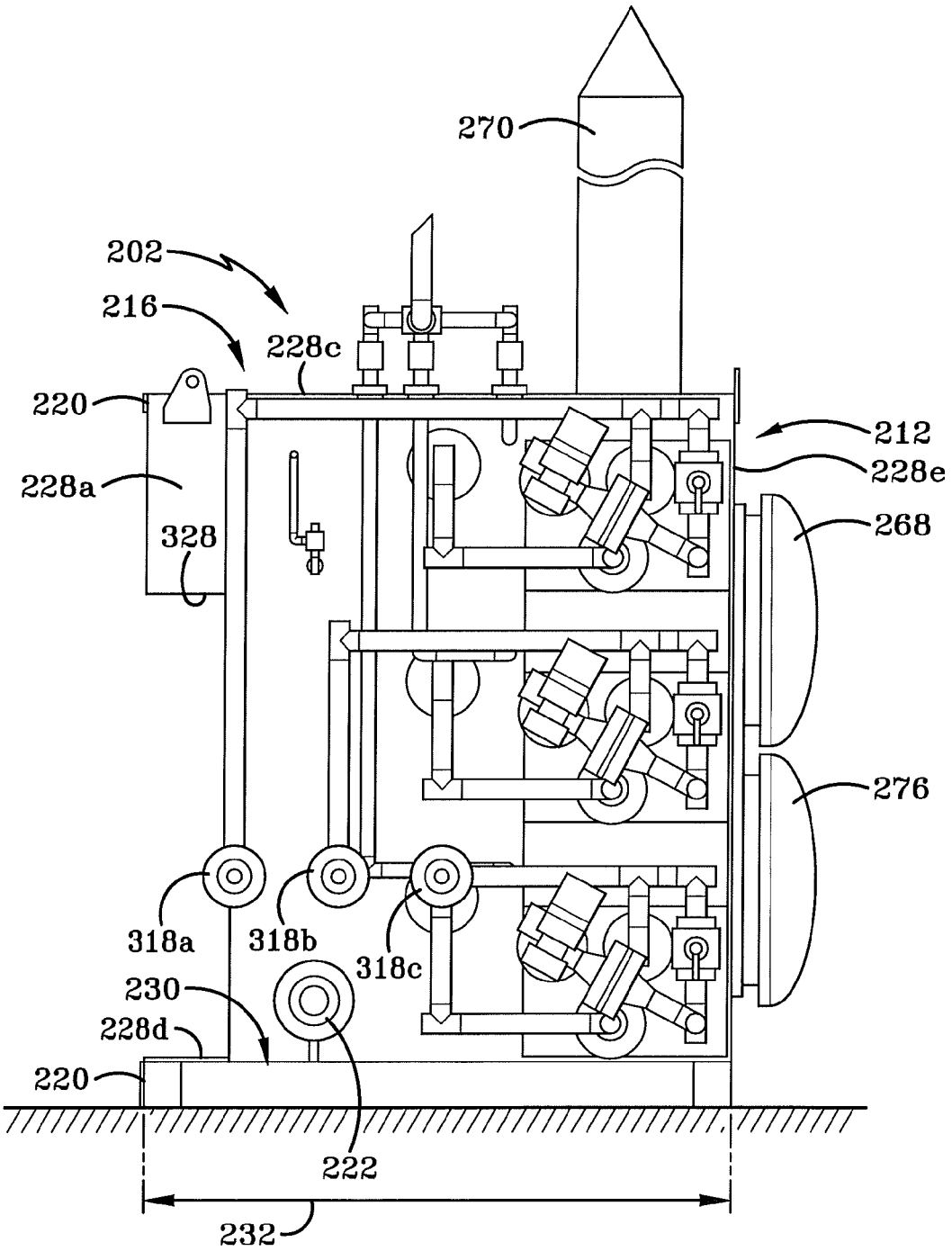
FIG. 21 is an end view similar to FIG. 20 but depicted with the sand separator removed.

As depicted in FIG. 19 and FIG. 20, the plurality of sand separators 204 are positioned laterally outside or outboard or to the right of first side 212 in an assembled position. A width 314 of the plurality of sand separators 204 is equal to or less than the width 232 of first module 216. Width 314 of the plurality of sand separators 204 is configured to be less than the National Highway Transportation Administration maximum width for an item to be towed by a tractor trailer. This enables the plurality of sand separators to be transported separate from the first module 216 to a well site location and be installed adjacent the first module 216.

Each of the sand separators has an inlet and an outlet. First sand separator 204*a* includes an inlet 316*a* and an outlet 316*b*. Outlet 316*b* is connected to pipeline 316*c* which is operatively connected to an inlet 318*a* controlled by a valve 320*a* of the fluid stream pathway associated with the first set of serpentine pipeline 274 and the first gas separator 242.

Second sand separator 204*b* includes an inlet 322*a* and an outlet 322*b* and outlet piping 322*c* in fluid communication with an inlet 318*b* controlled by valve 320*b*. Inlet 318*b* controlled by valve 320*b* is part of the second flow stream gas pathway associated with the second set of heat exchanging serpentine pipeline 284 and second gas separator 244.

Third sand separator 204*c* includes and inlet 324*a* and an outlet 324*b*. Outlet 324*b* is connected to outlet piping 324*c* which is operatively connected to an inlet 318*c* controlled by a valve 320*c*. Inlet 318*c* is operatively connected and in fluid communication with a third set of heat exchanging serpentine pipeline 286 which is connected to third gas separator 246.

In accordance with one exemplary non-limiting aspect the present disclosure, gas processing system 200 comprising transportable gas production unit 202 having first and second modules 216, 218 sized to fit atop a flatbed trailer 166 without the need for extra permitting enables significant fossil fuel processing while simultaneously allowing easy installation and removal.

A manufacturer assembles the rigid walls of the five-side box-like structure of each module atop a skid frame at a manufacturing location. Once the wall of the box are fabricated, the manufacture may install the pipeline that is associated with the heat exchanger 260. Alternatively, the heat exchanger pipeline may be fitted between the walls of the box-like housing and the heat exchanger walls during fabrication of the housing.

The plurality of stacked separators 240 are then installed within the housing by loading them in through the open side of the housing free of any upstanding vertical wall. Then, the remaining pipeline connections may be connected to established three distinct gas flow pathways associated with the first module.

The same assembly is repeated for the second module. After each module has been assembled, the module is loaded onto a flatbed trailer 166 for towing behind a truck. As stated previously, the width of each module is less than the federal maximum width for transporting goods on a highway/freeway/expressway etc.

In one embodiment, the first module is loaded onto a first trailer and towed by a first truck to a well site location. The second module is loaded onto a second trailer and towed by a second truck to the well site location such that the two modules arrive at the well site location close in time to each other. Alternatively, if advantageous to the gas producer/operator, a single trailer and truck combination may be used to haul the first and second modules to the well site location. In this scenario, the first truck could tow the first module to the well site location and unload the first module. The first truck would then return to the second module and load it onto the trailer, turn around and deliver the second module to the well site location for unloading adjacent the first module.

In a similar manner, the same truck or another set of trucks will deliver the plurality of sand separators 204 to the well site location. The sand separators are also sized to have a width less than the federal maximum permitted for roadway transport. The plurality of sand separators should also be at the well site location before connecting components of gas processing system 200 together to establish the respective production gas flow stream pathways from each well.

Now that the first and second modules and the plurality of sand separators have been delivered to the well site location, the assembly of system 200 may begin at the well site location.

As stated previously, each module is a five sided box-like structure having a side that is free of any wall. The first and second modules are positioned in a manner such that the free opening side of each module faces the complementary opening on the other module. The modules are mated together in a side-by-side manner forming a longitudinally extending junction 220 running from the first end 209 to the second end 210.

Each end wall in the first and second sidewall forms half of a doorway cutout 328 such that when the first and second modules are mated together in the side-by-side configuration a whole doorway is formed. While not shown directly in the figures, clearly, an access door may fill the formed doorway.

Once the first and second modules have been fitted together, the sand separators and the wells may be connected to the gas production unit 202 via pipeline. In one particular embodiment, the well site location plurality of fossil-fuel producing wells at one site location. This may be viewed as a drilling lease on a piece of real property having multiple wells in the real property. Some of the figures depict instances in which the site location has four wells drilled on the property, and other figures depict instances where the site location has six well drilled on the property. Again, the number of wells on the property is clearly variable to suit the needs of a gas producer and are entirely within the real of possibility of the present disclosure.

Referring to FIG. 16, the first well may be connected via pipeline to the first sand separator. Pipeline may also extend from the first well to a bypass valve or bypass assembly 326 which bypasses the sand separator 204 if the extracted fossil fuel is sufficiently free of sand. Pipeline then connects the sand separator to the heat exchanging serpentine pipeline in the heat exchanger and then to the first gas separator. This downstream connection establishes a first gas flow stream pathway for the fossil fuel to travel from the upstream source of the first well downstream through the first gas separator.

Each of the other wells and separators are connected in a similar manner establishing distinct gas flow pathways from the respective upstream source well downstream to a gas separators.

Processing system 200 combines the processed gas downstream from each respective gas separator in a combining pipeline 252. While the combining pipeline is depicted as installed within the housing, clearly it may be exterior to housing, so long as it is downstream from each gas separator. However, it is entirely possible for the combining pipeline to be position upstream from each separator. This type of installation may be advantageous for gas production scenarios in which one well may be producing less fossil fuel than the other wells and the combined pipeline can then be fed into the plurality of stack gas separators to evenly distribute the separating workload performed by the separators.

The combining pipeline is then fed to a downstream destination, such as a sales line 226. The sales line may be connected to the fossil fuel grid/network or it may be fed to a storage tank for later use at the well site location.

One exemplary and non-limiting description of a heat exchanger is described in greater detail in co-pending and co-owned U.S. application Ser. No. 14/662,698, filed on Mar. 19, 2015, and in U.S. application Ser. No. 14/662,833, filed on Mar. 19, 2015, and in U.S. application Ser. No. 14/662,929, filed on Mar. 19, 2015, the entirety of each is herein incorporated by reference as if fully rewritten. Namely, in one exemplary embodiment, the burner tube is maintained at a temperature in a range from about 600° F. to about 800° F. This imparts heat to the fluid mixture (glycol, ethylene, and water) in chamber. The fluid mixture is in a range from about 150° F. to 200° F., more particularly in a range from 170° F. to 180° F., and preferably at 175° F. This heated fluid keeps serpentine heat changing pipes at a warm temperature while gas is expanded therein to reduce the pressure from a high first pressure to a lower second pressure.

Other examples of gas processing system 200 contemplated by the present disclosure include wherein the first module unit 216 supported by a first frame 230 having a first width 232 and a first length dimensionally sized for transport by a tractor pulled trailer 166 without a wide load permit, and a first set of gas processing devices 240 supported by the first module unit 216. A second module unit 218 supported by a second frame (not shown for brevity but similar to 232) having a second width and a second length dimensionally sized for transport by a second tractor trailer without a wide load permit, and a second set of gas processing devices (not shown for brevity but similar to 240) supported by second module unit. Junction 220 directly connecting the first module to the second module. The junction 220 extends lengthwise along the first and second modules 216, 218 thereby positioning the first and second modules side-by-side. This exemplary version may further include an assembled array configuration of the first and second set of gas processing devices when viewed from an end; wherein the first set of gas processing devices 240 includes a first gas separator 242 and a second gas separator 244 aligned with each other; and wherein the second set of gas processing devices includes a fourth gas separator (not shown for brevity but similar to 242) and a fifth gas separator aligned therewith (not shown for brevity but similar to 244).

Additionally, system 200 includes a third gas separator 246 and the first, second, and third gas separators 242, 244, 246 are vertically aligned in a stacked configuration. The second set of gas processing devices in module 218 includes a sixth gas separator (not shown for brevity but similar to 246) and the fourth, fifth, and sixth gas separators are vertically aligned in a stacked configuration.

System 200 defines a first gas flow pathway directing gas from an first upstream source, such as one of the wells **206*a*, to a downstream destination, such as sales pipeline 226, through the first gas separator 242. A second gas flow pathway directing gas from a second upstream source, such as one of the wells 206*b*, to the downstream destination through the second gas separator 244. These first and second gas flow pathways are independent and distinct from one another upstream from the first and second gas separators. A merged gas flow pathway formed from blending the first and second flow pathways in combining pipeline 252** is downstream from the first and second gas separators.

The sand separators also respectively define portions of the gas flow pathways. For example, first sand separator 204*a* defines a portion of the first gas flow pathway exterior the first module 216, and second sand separator 204*b* defining a portion of the second gas flow pathway exterior the first module 216. A bypass assembly 326 is operatively connected to the first and second sand separators, wherein the bypass assembly permits fuel moving downstream along the first pathway to bypass the first sand separator and flow directly from a fuel source to the first gas separator; and the bypass assembly permits fuel moving downstream along the second pathway to bypass the second sand separator and flow directly from a second fuel source to the second gas separator.

Exemplary methods of use relating to system 200 may include the steps of pumping fossil fuel from a first well head 206*a* at a well site location along a first gas flow pathway; pumping fossil fuel from a second well head 206*b* at the well site location along a second gas flow pathway; decreasing pressure of the fossil fuel along the first gas flow pathway in a first set of heat exchanging pipeline 274 submerged in heated fluid; decreasing pressure of the fossil fuel along the second gas flow pathway in a second set of heat exchanging pipeline 284 submerged in heated fluid; separating fossil fuel from other constituents along the first gas flow pathway in a first gas separator 242; separating fossil fuel from other constituents along the second gas flow pathway in a second gas separator 244; wherein the first and second gas separators are housed in a first module and aligned in a vertically stacked configuration, the having a width less than the minimum width requiring a wide/oversized load permit; combining the first and second gas flow pathways downstream, in combining pipeline 252, from the first and second gas separators.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

What is claimed:

1. A heat exchanger on a fossil fuel processing assembly comprising:

a container defining a plurality of distinct fluid filled chambers;

a plurality of heat sources equal to the number of fluid filled chambers, wherein one heat source is disposed within one chamber; and a plurality of heat exchanging pipelines equal to the number of fluid filled chambers, wherein one pipeline is submerged within in fluid inside one chamber and the pipelines bounding fossil fuel flowing therethrough.

2. The heat exchanger of claim 1, wherein only one heat source is disposed within only one fluid filled chamber.

3. The heat exchanger of claim 1, wherein the fluid in each chamber does not mix with fluid from another chamber.

4. The heat exchanger of claim 1, wherein each one of the plurality of heat exchanging pipelines is fed independently from a different fuel source.

5. The heat exchanger of claim 1, further comprising a vertical sidewall aligning the plurality of distinct chambers in a directly vertical stacked configuration.

6. The heat exchanger of claim 5, further comprising:

a central plane, wherein each one of the plurality of heat sources intersects the imaginary central plane; and wherein the plurality of heat sources are aligned in a directly vertical stacked configuration.

7. The heat exchanger of claim 6, a serpentine configuration of the heat exchanging pipeline within each fluid filled chamber.

8. The heat exchanger of claim 1, further comprising three fluid filled chambers, three heat sources, and three heat exchanging pipelines.

9. The heat exchanger of claim 1, wherein each one of the plurality of heat exchanging pipelines includes:

a plurality of pre-heat pipe segments connected fluidly in series including an ultimate pre-heat segment; and a plurality of expansion pipe segments connected fluidly in series including an initial expansion segment;

wherein the ultimate pre-heat segment is fluidly coupled upstream to the initial expansion segment.

10. The heat exchanger of claim 9, wherein the number of pre-heat pipe segments is in a range from 4 to 8.

11. The heat exchanger of claim 10, wherein the number of expansion pipe segment is equal to the number of pre-heat pipe segments.

12. The heat exchanger of claim 9, wherein the ultimate pre-heat segment is offset and aligned coplanar with the initial expansion segment.

13. A heat exchanger on a fossil fuel processing assembly comprising:

a first endwall opposite a second endwall defining a longitudinal direction therebetween, a first sidewall opposite a second sidewall defining a transverse direction therebetween, and a top wall opposite a bottom wall defining a vertical direction therebetween;

a first partition wall extending transversely between the first and second sidewalls and extending longitudinally between the first and second endwalls;

wherein the first and second endwalls, the first and second sidewalls, the top wall, and the first partition wall define a first chamber;

a second partition wall below the first partition wall extending transversely between the first and second sidewalls and extending longitudinally between the first and second endwalls;

wherein the first and second endwalls, the first and second sidewalls, the first partition wall, and the second partition wall define a second chamber below the first chamber;

wherein the first and second endwalls, the first and second sidewalls, the second partition wall, and the bottom wall define a third chamber below the first and second chambers;

a first fluid at least partially filling and bound in the first chamber;

a second fluid at least partially filling and bound in the second chamber;

a third fluid at least partially filling and bound in the third chamber;

wherein the first, second, and third fluids are similar formulations but do not mix;

a first heat source at least partially submerged in the first fluid in the first chamber;

a second heat source at least partially submerged in the second fluid in the second chamber;

a third heat source at least partially submerged in the third fluid in the third chamber;

a first heat exchanging pipeline submerged in the first fluid in the first chamber having a plurality of parallel segments connected together by transitional segments forming a general serpentine configuration, the first heat exchanging pipeline defining a portion of a first fossil fuel flow pathway from a first fuel source, and including a plurality of pre-heat pipe segments serially connected adjacent the first heat source adapted to warm fossil fuel fluidly moving through the pre-heat pipe segments and a plurality of expansion pipe segments serial connected in downstream fluid communication with the plurality of pre-heat pipe segments adapted to permit fossil fuel expansion therein as the fossil fuel fluidly moves through the expansion pipe segments;

a second heat exchanging pipeline submerged in the second fluid in the second chamber having a plurality of parallel segments connected together by transitional segments forming a general serpentine configuration, the second heat exchanging pipeline defining a portion of a second fossil fuel flow pathway from a second fuel source, and including a plurality of pre-heat pipe segments serially connected adjacent the second heat source adapted to warm fossil fuel fluidly moving through the pre-heat pipe segments and a plurality of expansion pipe segments serially connected in downstream fluid communication with the plurality of pre-heat pipe segments adapted to permit fossil fuel expansion therein as the fossil fuel fluidly moves through the expansion pipe segments; and a third heat exchanging pipeline submerged in the third fluid in the third chamber having a plurality of parallel segments connected together by transitional segments forming a general serpentine configuration, the third heat exchanging pipeline defining a portion of a third fossil fuel flow pathway from a third fuel source, and including a plurality of pre-heat pipe segments serially connected adjacent the third heat source adapted to warm fossil fuel fluidly moving through the pre-heat pipe segments and a plurality of expansion pipe segments serially connected in downstream fluid communication with the plurality of pre-heat pipe segments adapted to permit fossil fuel expansion therein as the fossil fuel fluidly moves through the expansion pipe segments.

* * * * *